US010415226B2

(12) United States Patent
Lacouture

(10) Patent No.: US 10,415,226 B2
(45) Date of Patent: Sep. 17, 2019

(54) FILTRATION SYSTEM

(71) Applicant: Larry Lacouture, Baton Rouge, LA (US)

(72) Inventor: Larry Lacouture, Baton Rouge, LA (US)

( * ) Notice: Subject to any disclaimer, the term of this patent is extended or adjusted under 35 U.S.C. 154(b) by 0 days.

(21) Appl. No.: 15/845,470

(22) Filed: Dec. 18, 2017

(65) Prior Publication Data

US 2019/0186117 A1 Jun. 20, 2019

(51) Int. Cl.
*E03F 5/04* (2006.01)
*E03F 5/06* (2006.01)

(52) U.S. Cl.
CPC ..... *E03F 5/0404* (2013.01); *E03F 5/0403* (2013.01); *E03F 5/0406* (2013.01); *E03F 5/06* (2013.01); *E03F 2005/0418* (2013.01)

(58) Field of Classification Search
CPC ..... E03F 5/0401; E03F 5/0403; E03F 5/0404; E03F 5/0405; E03F 5/0406; E03F 2005/0416; E03F 2005/0418
USPC .... 210/163, 164, 170.03, 747.3; 404/2, 4, 5, 404/25
See application file for complete search history.

(56) References Cited

U.S. PATENT DOCUMENTS 1,469,790 A * 10/1923 Hysko ..... E03F 5/042 210/164
1,507,531 A * 9/1924 Vaudell ..... E03C 1/29 210/164
2,263,259 A * 11/1941 Boosey ..... E03C 1/282 210/164
4,776,722 A * 10/1988 Gaudin ..... E02D 29/14 210/164
5,744,048 A * 4/1998 Stetler ..... E03F 5/0401 210/164
6,086,758 A * 7/2000 Schilling ..... E03F 5/0404 210/164
6,287,459 B1 * 9/2001 Williamson ..... E03F 5/14 210/164
7,112,274 B1 * 9/2006 Sanguinetti ..... E03F 5/0404 210/163
7,771,591 B2 * 8/2010 Lucas ..... E03F 5/0404 210/163
2010/0176041 A1 * 7/2010 Schlueter ..... E03F 5/0407 210/163
2013/0186811 A1 * 7/2013 Kaiser ..... E03F 5/0404 210/163

FOREIGN PATENT DOCUMENTS

DE 102013109367 * 3/2015
EP 386696 * 9/1990

* cited by examiner

*Primary Examiner* — Christopher Upton
(74) *Attorney, Agent, or Firm* — Zachary Christiansen

(57) ABSTRACT

The present invention discloses a filtration device for use in municipal and industrial sewer systems. In one embodiment, the instant invention comprises a device that filters runoff, preventing unwanted chemicals and debris from entering the sewer system. The device comprises a sewer seal that forms a liquid seal to trap hydrocarbons, such as oil, and prevent odors from leaking from the sewer system, while still allowing water to flow through the system. The trap is removable, allowing for easy cleaning, replacement, and maintenance.

12 Claims, 36 Drawing Sheets

'Examining If Any Filters Or Debris Within The Filtration System Need Cleaning' 3400

FILTRATION SYSTEM

CROSS REFERENCE TO RELATED APPLICATIONS

Not applicable.

REFERENCE TO GOVERNMENT FUNDING SOURCES

Not applicable.

REFERENCE TO SEQUENCE LISTING

Not applicable.

FIELDS OF THE INVENTION

The disclosure as detailed herein is in the technical field of sewer systems, runoff catch basins, and vapor seal sewer systems.

DESCRIPTION OF RELATED ART

In many places where buildings exist, rainwater and other runoff collects in areas of the property. Therefore, catch basins are used to collect and divert runoff into sewer systems. Because runoff often contains contaminants such as hydrocarbons, sediments, and trash, there are mechanisms to prevent these contaminants from entering the sewer system.

Sewer systems are designed to collect all surface runoff from streets, parking lots, etc. through a series of catch basins and a network of underground piping that flows to a treatment system to be treated until it can be discharged or disposed of if contaminated. All sewer systems, whether it's Municipal, Refinery, Petrochemical, Paper Mill, etc., have a problem that is common to all. Debris such as sand, dirt, oil, gravel, small tree limbs, leaves, cans, bottles, small animals, oil, grease, etc. will wash into the catch basins and underground lines causing plugging and a reduction in flow.

Commercial entities such as refineries, petrochemical plants, paper mills, and power plants have a need for proper draining of runoff, usually with consideration for potentially hazardous chemicals. This runoff is usually captured via drain hubs and catch basins and commercial entities typically have separate oily water and storm water systems for drainage. In order to protect the environment, treatment centers are usually created to process the runoff before returning it to nearby water sources.

In some municipal-related embodiments of this system, the runoff flows down to the treatment plant. However, there is often little or no prevention or separation mechanism to prevent chemicals, oils, and other debris prior to entering the treatment plant.

If a person illegally dumps chemicals into the system, such as paint, oil, or other waste, these materials can flow directly into the municipal treatment system. This is a danger to society as these chemicals may leak into municipal water systems, causing birth defects, cancer, and other health and environmental concerns. Moreover, these agents and preventive measures that are used to ameliorate them increase the cost of water treatment.

Storm water system drains, whether a municipal street or parking lot, refinery, chemical plant, paper mill, etc., all face similar problems. Debris such as sand, dirt, gravel, tree limbs, leaves, cans, bottles, small animals, oil, grease, etc. can wash into catch basins and into the underground storm water lines, causing plugging and a reduction in flow.

GENERAL SUMMARY OF THE INVENTION

Within this invention and expanding upon a previous invention from this inventor, the inventor uses an S- or P-trap to form a liquid seal where hydrocarbons and oil will float on the surface of the seal, thereby preventing hydrocarbons from entering the sewer system. This invention provides for a removable trap, along with a filtering system that exists prior to outlet into the sewer system.

A filtration system has been designed that will trap all debris as it enters the catch basin, allowing only water to the underground piping system, thereby keeping the underground piping clear of any debris and maintaining full flow capacity.

In some commercial-related embodiments of this system, the runoff is filtered prior to being received at the treatment system, to prevent accumulation of unwanted chemicals and debris. This decreases the need to process the runoff at the treatment system, prior to release, saving treatment costs and preventing fines/lawsuits from improperly treated water. The filtering performed by this system is intended to meet the EPA requirements for QQQ, B-1 HON, API 500, Storm Water Phase II, and other regulations. The physical components of the system are also preferably made of stainless steel so that they are lightweight and easily removable (easily manageable by commercial entities and municipal entities).

In municipal-related embodiments of this system, everything except water will be filtered prior to the treatment system. This will decrease the need to process the runoff at the treatment system prior to release, saving treatment costs and avoiding health and environmental problems. These embodiments are also intended to meet the EPA Storm Water Phase II and other regulations.

It is thought that a combination of a filter and trap will prevent odors from leaking from the sewer system and out of the catch basin, and will remove hydrocarbons and large particles. A changeable filter can be used to further clean the runoff down to the micron level wherein said filter may be a HEPA filter and the like.

The Storm Drain with built in debris separation and oil/grease separation meets the requirements for EPA Storm Water Phase II regulations. The Storm Drain is designed to prevent any debris, oil, or grease from getting into the underground storm water lines. Only water will pass through the Storm Drain, keeping the underground storm water lines clear of any debris, oil or grease and at full flow capacity.

DETAILED DESCRIPTION

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural, logical, software, electrical and other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

The functionality or the features of a device may be alternatively embodied by one or more other devices that are not explicitly described as having such functionality or features. Thus, other embodiments of one or more of the inventions need not include the device itself.

Figure 1:
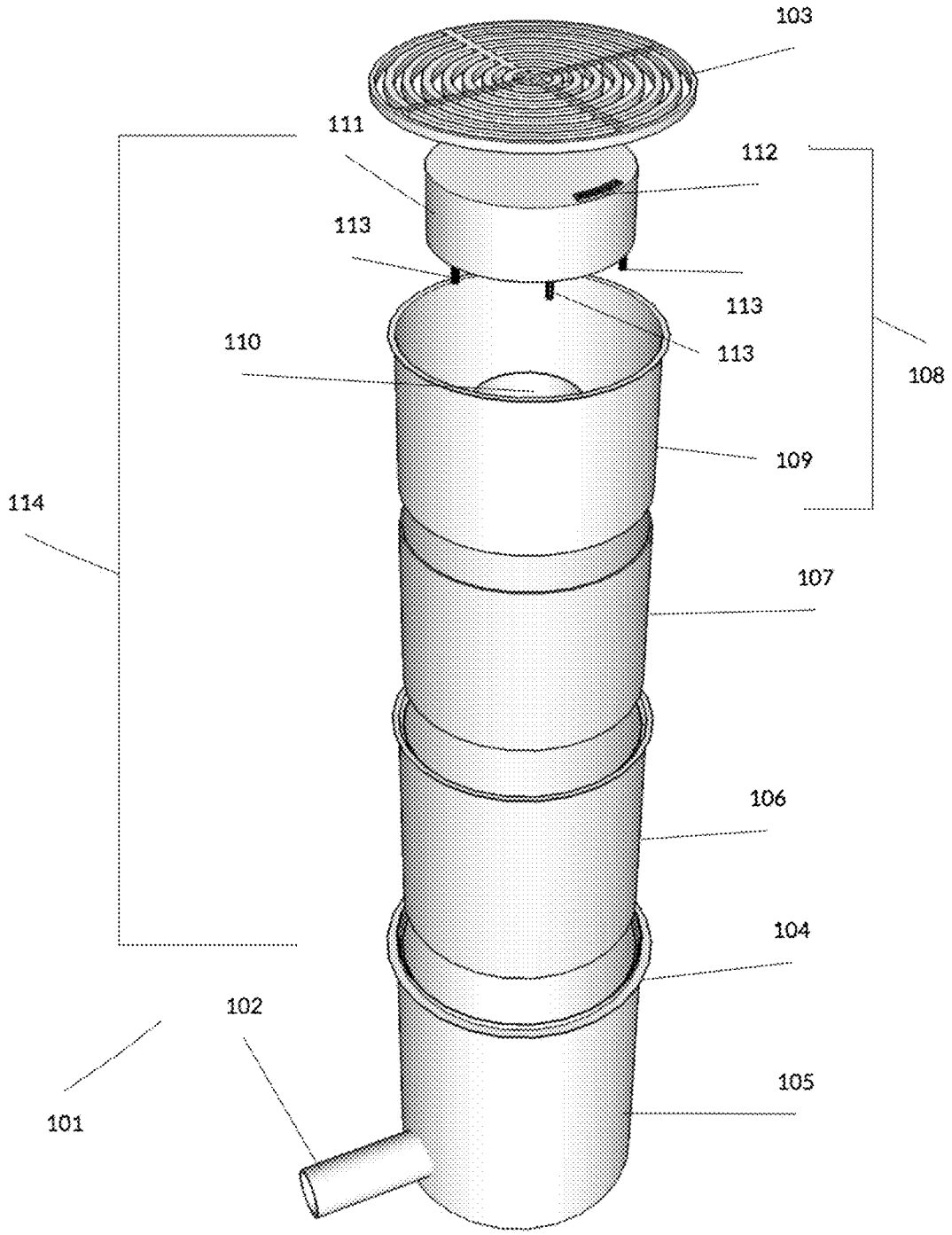
FIG. 1 is an exploded view of the filtration system catch basin and assembled components (added Removable Filtration Structure Component).

Referring now to FIG. 1, which shows an exploded view of the filtration system catch basin and assembled components. Filtration system 101 comprises a three-stage filtration system designed with 2 chambers to separate debris and oil/grease. One goal of filtration system 101 is to allow for water to be discharged to a municipal sewer system or waterway after filtration.

Filtration system 101 preferably comprises removable filtration structure 114, fabricated frame system 104, grate 103, and catch basin 105, and finally, in some embodiments filter media 107. While the filtration system may be used to drain water from large square footage areas, the filtration system 101 has an alternative embodiment that may be integrated with an existing catch basin 105 on a street side where the grate 103 is set back from the curb side.

In some embodiments, removable filtration structure 114 comprises severable components that nest inside one another below a grate 103 and above or within a catch basin 105 that can be lifted by a person for cleaning out material from a water seal 108 and/or change removable filter media 107. The purpose of the removable filtration structure 114 is to allow easy cleaning for one or more individuals for management of a drainage system for dealing with runoff in commercial environments and municipalities. Removable filtration structure 114 preferably comprises filter basket 106 (in some embodiments) and sewer seal 108.

The catch basin 105 is connected to an underground piping system 102, near the bottom of the filtration system. The underground piping system 102 comprises a system of underground pipes that convey fluids from one location to another.

Catch basin 105 comprises a cistern or reservoir that accepts street gutter discharge that is destined for the sewer and surface water runoff. It helps catch and hold debris and other matter that may otherwise clog the sewer. Catch basin 105 is preferably positioned beneath grate 103, surrounding frame 201, and surrounding sewer seal 108 and is attached to underground piping system 102. In some embodiments, it is a self-contained structure or part of a prefabricated structure.

Catch basin 105 is preferably shaped like a cylinder; however, it is thought that in alternative embodiments, that it may also be shaped like a cube or alternately, a rectangle. Catch basin 105 is mainly thought to be composed of stainless steel; however, in some embodiments, it is thought that in the thing may also be composed of concrete or alternately, other materials capable of withstanding corrosive conditions. One goal of catch basin 105 is to allow surface water to flow through and into underground piping system 102.

Situated on top of the catch basin is fabricated frame system 104 which may be embedded within the catch basin 105 surrounding substrate. Fabricated frame system 104 is preferably positioned to accept the grate 103 above the catch basin 105 and is mainly thought to be composed of 304 stainless steel; however, it is thought that in alternate embodiments that the thing may also be composed of 316L stainless steel in areas where salt intrusion can corrode the system components. Fabricated frame system 104 functions to receive the grate 103 and hold the filter basket 106 with filter media 107. Fabricated frame system 104 preferably comprises frame 201.

Fabricated frame system 104 has an alternative embodiment including both a pre-cast frame and grate 103. A pre-cast frame comprises the component that serves to support all system components, including grate 103, filter basket 106, and sewer seal 108. The grate 103 in this system can also be used in fabricated frame system 104 as well. A pre-cast grate and frame system is mainly thought to be composed of cast iron and functions to 1) allow one to easily purchase prefabricated grate from a manufacturer and to 2) allow for easy adaptation.

Within the fabricated frame system 104 is the grate 103. This is preferably positioned in the middle of the frame 201, on top of the filtration system 101, and on top of the grate ledge 301. Grate 103 comprises an opening to the filtration system 101 that interacts with the grate ledge 301 of the frame by resting on it. Grate 103 allows the surface water to drain into the underground sewer system. It also serves to keep people from falling through, and keep out trash and debris.

Grate 103 is preferably shaped like a circle; however, it is thought that in alternative embodiments, that it may also be shaped like a rectangle or alternately, a square. Grate 103 is mainly thought to be composed of cast iron; however, other embodiments may be composed of any of the following: fiberglass, plastic, rubber, or fabricated bar grating where bearing bars and cross pieces form an opening.

In some embodiments, grate 103 has a preferred diameter of 28 inches but in some embodiments, may range from a minimum of 8 inches to a maximum diameter of 40 inches. In some embodiments, grate 103 has a preferred thickness of 6.75 inches but in some embodiments, may range from a minimum of 1.5 inches to a maximum thickness of 12 inches. In some embodiments, the thickness of grate 103 can be calculated by that which is specific to the quantity of water that flows through the grate.

In embodiments where the grate dimensions can be determined by flow rate, grate 103 has a preferred flow rate of 750 gallons per minute, but in some embodiments, may range from a minimum of 500 gallons per minute to a maximum flow rate of 1000 gallons per minute. In some embodiments, the flow rate of grate 103 can be calculated by estimating local rainfall amounts that would interact with the grate.

Filter basket 106 is preferably positioned within frame 201 of the fabricated frame system 104. Filter basket 106 is also preferably positioned surrounding sewer seal 108, and within catch basin 105. In some embodiments, filter basket 106 has a preferred diameter of 27¾ inches but in some embodiments, may range from a minimum of 6 inches to a maximum diameter of 60 inches. In some embodiments, filter basket 106 has a preferred depth of 19¾ inches but in some embodiments, may range from a minimum of 6 inches to a maximum depth of 60 inches. In some embodiments, the depth of filter basket 106 is determined by the size that allows a fit within catch basin 105. Filter basket 106 functions to both 1) provide sturdy housing for replaceable filter media 107 and to 2) hold sewer seal 108. In some embodiments, filter basket 106 comprises sewer seal ledge 503, filter basket flange 501, perforated cylinder 502, and basket to filter attachment mechanism 2701.

In some embodiments, filter media 107 comprises a replaceable filter that fits within the filter basket 106. Filter media 107 is perforated attached to perforated cylinder 502 with a plurality of attachment mechanisms and is preferably positioned within perforated cylinder 502. Filter media 107 is preferably shaped specific to shape of perforated cylinder 502 in order to cover surface area of perforated cylinder 502. In some embodiments, it is thought that if filter media 107 is absent, then filtration system 101 is still useable, but items or debris will enter the sewer system. A purpose of filter media 107 is to filter any particles that make it through sewer seal 108 and serve as the final filtration stage. In some embodiments, it may also serve to filter out organic liquids and-or filter particles down to the micrometer level.

Within the filter basket, resting on the sewer seal ledge 503, is sewer seal 108. In some embodiments, sewer seal 108 comprises a device or system of components that allows water to flow through while blocking system vapors from returning to system, that serves to separate oil and debris and prevent them from entering underground piping system 102. Spatially, sewer seal 108 is preferably positioned within filter basket 106 so that it rests on sewer seal ledge 503 and is preferably shaped like a cylinder. However, it is thought that in alternative embodiments, that it may also be shaped like a square or alternately, rectangularly. The components of sewer seal 108 are preferably thought to be composed of stainless steel and it functions to both 1) trap and prevent gases and odors from returning to surface and to 2) prevent loss of organics into underground piping system 102. In some embodiments, sewer seal 108 comprises cap 111 and upper chamber 109.

In some embodiments, upper chamber 109 comprises a cavity system that, with cap 111, forms part of sewer seal 108. Spatially, upper chamber 109 is preferably positioned surrounding cap 111 and below cap 111. Further, upper chamber 109 is preferably shaped like a cylinder; however, it is thought that in alternative embodiments, that it may also be shaped like a rectangle or alternately, a square. In some embodiments, the size of the upper chamber 109 can be calculated by the flow rate corresponding to the dynamics of the underground piping system 102.

In some embodiments, the diameter of upper chamber 109 can be calculated by corresponding to the size of sewer seal 108, in general. Upper chamber 109 functions to both 1) create a supporting structure for cap 111 to rest on and to also 2) provide the dimensions for creating upper chamber annulus 1301 for annular flow through overflow weir 110. In some embodiments, upper chamber 109 preferably comprises upper chamber flange 1402, overflow weir 110, upper chamber outer wall 1401, and upper chamber annulus 1301.

Within the center of the upper chamber 109 is the overflow weir 110. In some embodiments, overflow weir 110 comprises an apparatus that serves as a barrier with an opening that water flows through. Along with the cap 111, it collectively forms a water/vapor seal within the sewer seal 108 structure. Spatially, overflow weir 110 is preferably positioned within the center of upper chamber 109.

Overflow weir 110 is preferably shaped like a circle or square. In some embodiments, the overflow weir 110 may have thicker, reinforced walls to account for ground forces. Preferably the height of overflow weir 110 is calculated by the desired flow rate of the filtration system. In some embodiments, overflow weir 110 comprises upper chamber flow aperture 1302 and a cap weir seal distance that defines.

In some embodiments, cap 111 comprises a central removable apparatus that forms the lid of the water seal within sewer seal 108. It operably divides the upper chamber annulus 1301 into inner annulus 1701 and outer annulus 1801 to form the water/vapor seal. Spatially, cap 111 is preferably positioned on top of overflow weir 110 and sits within upper chamber 109.

In some embodiments, cap 111 is preferably shaped like a circle; however, it is thought that in alternative embodiments, that it may also be shaped like a rectangle or alternately, a square. Like other components of the sewer seal 108, the diameter of cap 111 can be calculated by the height of the weir and the dynamics of the preferred flow rate. In some embodiments, cap 111 preferably comprises handles 112, feet 113, and cap top 1601.

The base of cap 111 has a plurality of feet 113 attached to the cap 111. Feet 113 are preferably L-shaped and preferably thought to be composed of stainless steel. Feet 113 have many purposes as follows: First, feet 113 keep cap 111 elevated in upper chamber 109 for the weir system and prevent cap 111 from sitting directly on floor of upper chamber 109. Next, it serves to allow one to create inner annulus 1701 and outer annulus 1801 by allowing water to flow through the two annuli. Further, feet 113 serve to set the distance for the water seal. In some embodiments, feet 113 preferably create a feet gap.

Handles 112, positioned on top of the cap 111 allow one to remove cap 111 to inspect or clean sewer seal 108.

Figure 2:
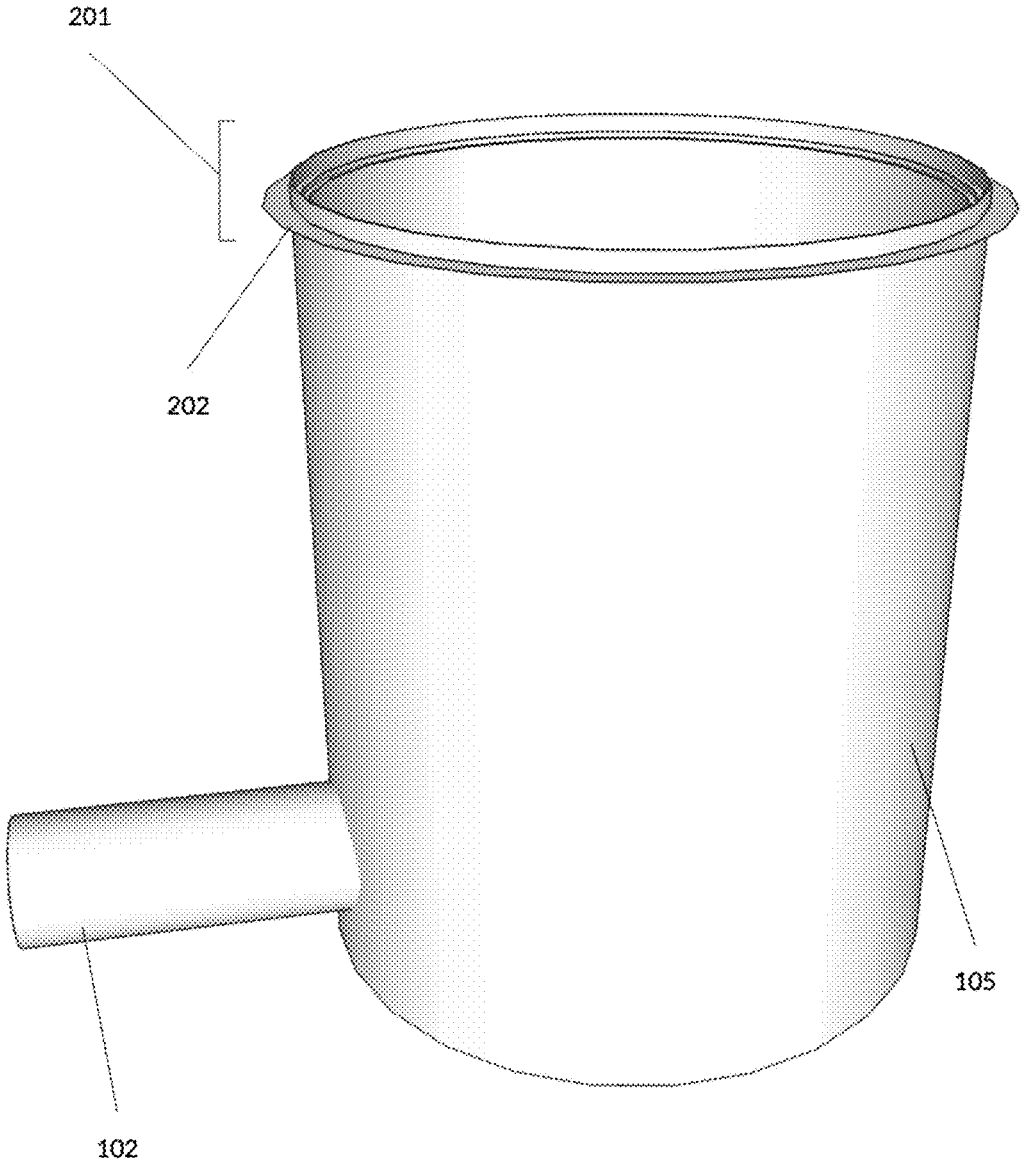
FIG. 2 is a perspective view of a circular catch basin and attached frame.

Referring now to FIG. 2, which shows a perspective view of a circular catch basin and attached frame. In some embodiments, frame 201 comprises the component that serves to support all system components, including grate 103, filter basket 106, sewer seal 108 and forms entry point for grate 103. Frame 201 supports the grate 103 by the grate ledge 301 (and in some embodiments, the filter basket 106). Frame 201 may also support the filter basket 106 by the basket ledge. Frame 201 is attached to surrounding substrate by gussets or other means and is attached to catch basin 105 by welding or other attachment means.

Frame 201 is preferably positioned above catch basin 105, surrounding grate 103, and surrounding filter basket 106. Frame 201 is mainly thought to be composed of stainless steel; however, other embodiments may be composed of any of the following: cast iron, carbon steel, Monel 400, aluminum, or other rugged, durable materials such as metal. In some embodiments, the diameter of frame 201 can be determined by the diameter of grate 103 because it functions to hold grate 103.

In some embodiments, it is thought that if frame 201 is absent, then a person can substitute a concrete ledge that may suffice. Frame 201 (as designed within this filtration system) allows more flexibility than bought pre-cast frames. It serves to allows filtration system 101 to connect to surrounding substrate and also to provide ledges to hold grate 103, and-or filter basket 106. In some embodiments, frame 201 preferably comprises a surrounding substrate affixment system 202, basket ledge 302, and finally, grate ledge 301.

Surrounding substrate affixment system 202 comprises a way to affix frame 201 to the surrounding environment, for example by pouring concrete into components of the surrounding substrate affixment system. In some embodiments, rather than pouring concrete, one may just bring the surrounding substrate (such as dirt or gravel) up to the frame 201 level.

Surrounding substrate affixment system 202 allows one to walk or drive on the filtration system 101 as it integrates the filtration system with the environment. It further serves to level filtration system 101 to surrounding substrate and keep the surrounding substrate stable.

Figure 3:
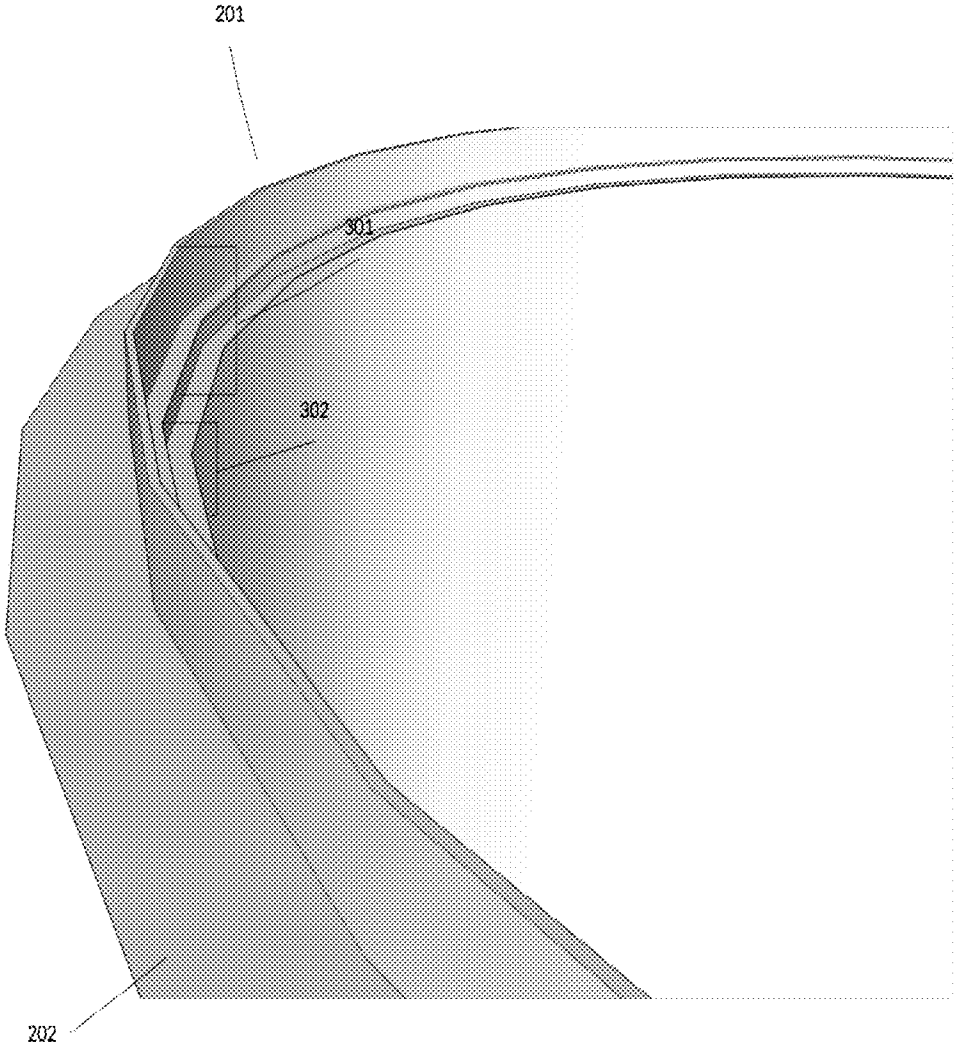
FIG. 3 is a perspective view of frame edge with two ledges for accommodating components.

Referring now to FIG. 3, which shows a perspective view of frame edge with two ledges for accommodating components. In some embodiments, grate ledge 301 comprises lip or brim that grate 103 sits upon and is positioned peripherally to said basket ledge 302. In some embodiments, grate 103 sits on grate ledge 301, while in other embodiments, grate 103 sits on filter basket flange that sits on grate ledge 301. In some embodiments, grate 103 sits flush when filter basket 106 sits on the grate ledge 301. In other embodiments, grate 103 sits slightly raised when filter basket 106 is in place.

In some embodiments, grate ledge 301 supports grate 103 and/or filter basket 106. In some embodiments, grate ledge 301 comprises grate ledge vertical surface 401 and grate ledge horizontal surface 402.

In some embodiments, basket ledge 302 comprises a brim or lip that holds and supports filter basket 106 and is positioned centrally to grate ledge 301. In some embodiments, it is thought that if basket ledge 302 is absent, then grate ledge 301 may be manufactured to accommodate filter basket 106, which would then sit on grate ledge 301. In some embodiments, basket ledge 302 preferably comprises basket ledge horizontal surface 403.

Figure 4:
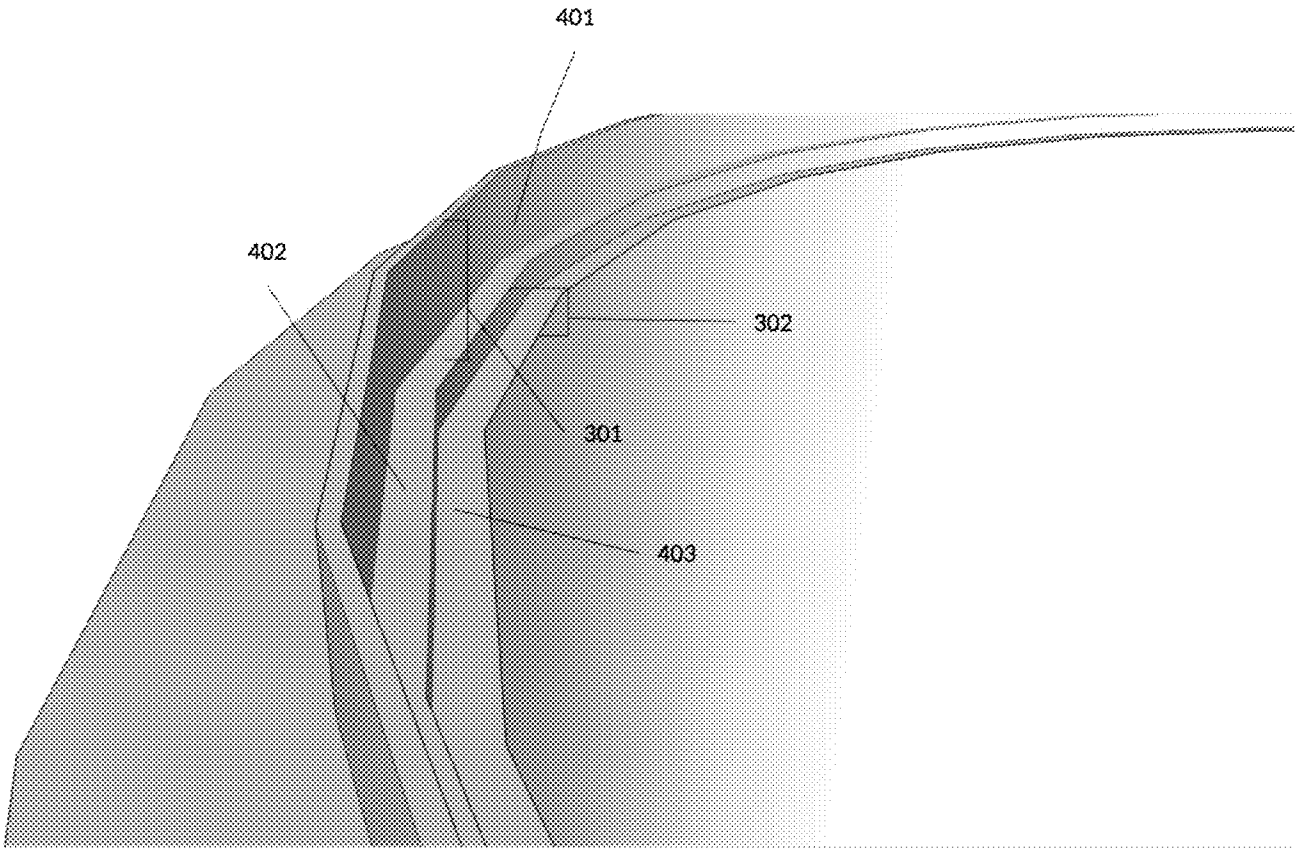
FIG. 4 is a perspective view of frame edge with double ledges for inserting components.

Referring now to FIG. 4, which shows a perspective view of frame edge with double ledges for inserting components. Grate ledge horizontal surface 402 comprises the horizontal surface, or width, of grate ledge 301.

Further, basket ledge horizontal surface 403 comprises the horizontal surface, or width, of basket ledge 302. Spatially, basket ledge horizontal surface 403 is preferably positioned below filter basket flange 501 when the filter basket is inside the frame. In some embodiments, basket ledge horizontal surface 403 has a preferred width of 2 inches but in some embodiments, may range from a minimum of 1 inches to a maximum width of 12 inches. In some embodiments, the width of basket ledge horizontal surface 403 can be determined by the width necessary to support weight of debris that collects in filter basket 106. One goal of basket ledge horizontal surface 403 is to stably support filter basket 106.

Figure 5:
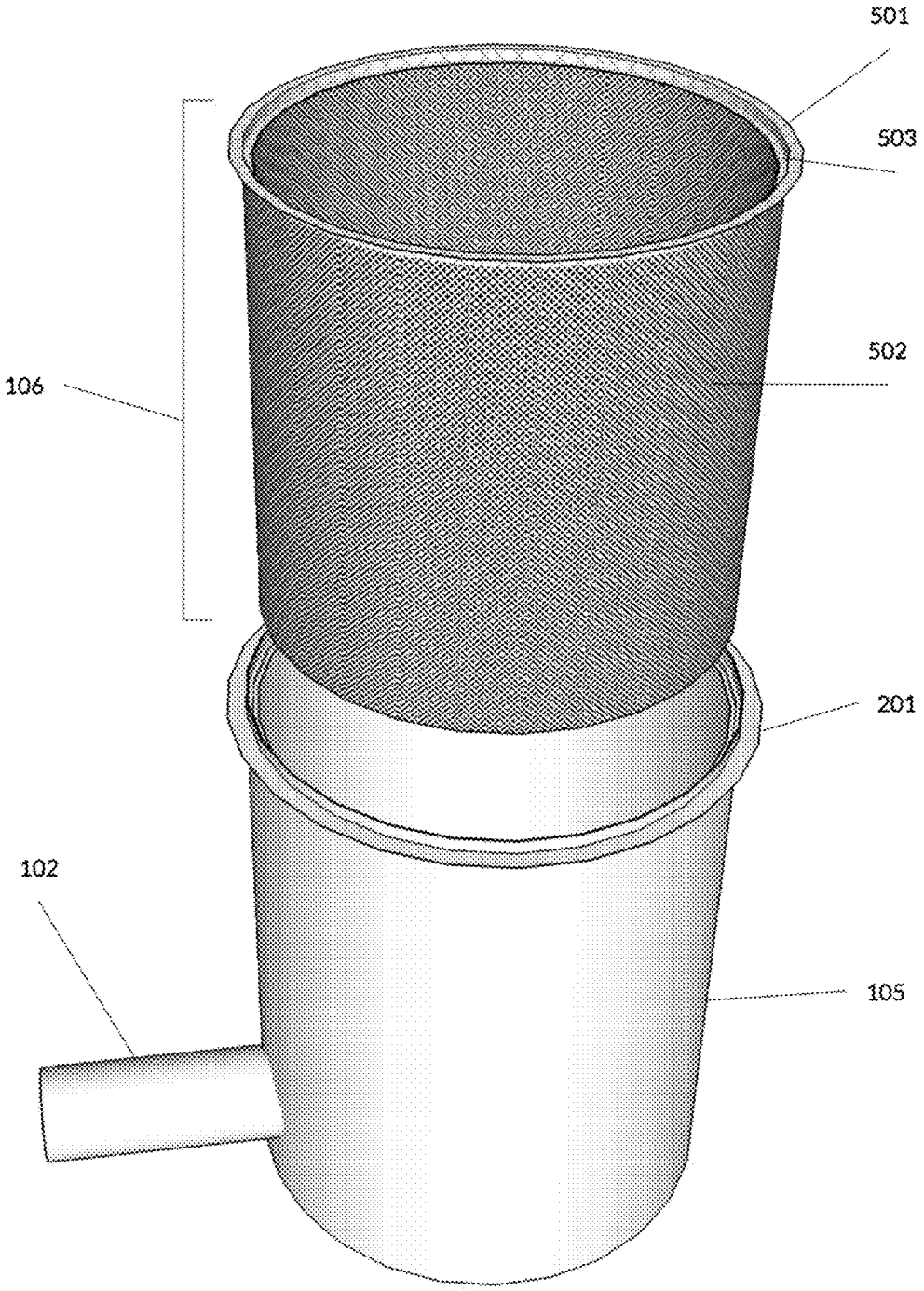
FIG. 5 is an exploded view of catch basin and basket insert that fits within the frame.

Referring now to FIG. 5, which shows an exploded view of catch basin and basket insert that fits within the frame. Filter basket flange 501 comprises a brim or lip on the filter basket 106 that interacts with basket ledge 302 and in some embodiments, also interacts with grate ledge 301.

Spatially, filter basket flange 501 is preferably positioned peripheral to perforated cylinder 502 and on top of perforated cylinder 502. Filter basket flange 501 is preferably thought to be composed of stainless steel and has a preferred thickness of ⅛ inches but in some embodiments, may range from a minimum of 1/32 inches to a maximum thickness of 3 inches.

In some embodiments, filter basket flange 501 has a preferred width of 2⅛ inches but in some embodiments, may range from a minimum of ½ inches to a maximum width of 12 inches. In some embodiments, filter basket flange 501 has a preferred outer diameter of 32 inches but in some embodiments, may range from a minimum of 12 inches to a maximum width of 60 inches. In some embodiments, the filter basket flange 501 may be supported by one or more gussets.

In some embodiments, perforated cylinder 502 (of the filter basket) comprises a structure with a flat, solid area at the top, followed by perforations along its sides and bottom that holds the filter media 107 and provides surface area for liquids to flow through while providing support for filter media 107. Perforated cylinder 502 is mainly thought to be composed of stainless steel and functions to both 1) allow water to flow through the perforations and to 2) hold the filter media 107. In some embodiments, perforated cylinder 502 preferably comprises perforated cylinder cross braces.

In some embodiments, sewer seal ledge 503 comprises a ring, welded inside filter basket 106 that supports sewer seal 108 and is gusseted for additional support. Sewer seal ledge 503 supports the sewer seal 108. Spatially, sewer seal ledge 503 is preferably positioned above filter media 107 and central to filter basket flange 501.

Sewer seal ledge 503 is mainly thought to be composed of stainless steel; however, it is thought that in alternate embodiments that the thing may also be composed of other materials appropriate to application environment.

In some embodiments, sewer seal ledge 503 has a preferred thickness of ⅛ inches but in some embodiments, may range from a minimum of 1/32 inches to a maximum thickness of ½ inches. In some embodiments, sewer seal ledge 503 has a preferred width of 1 3/16 inches but in some embodiments, may range from a minimum of ¼ inches to a maximum width of 3 inches. One goal of sewer seal ledge 503 is to helps keep filter media 107 from shifting during securing. In some embodiments, Sewer seal ledge 503 preferably comprises sewer seal gusset support.

Figure 6:
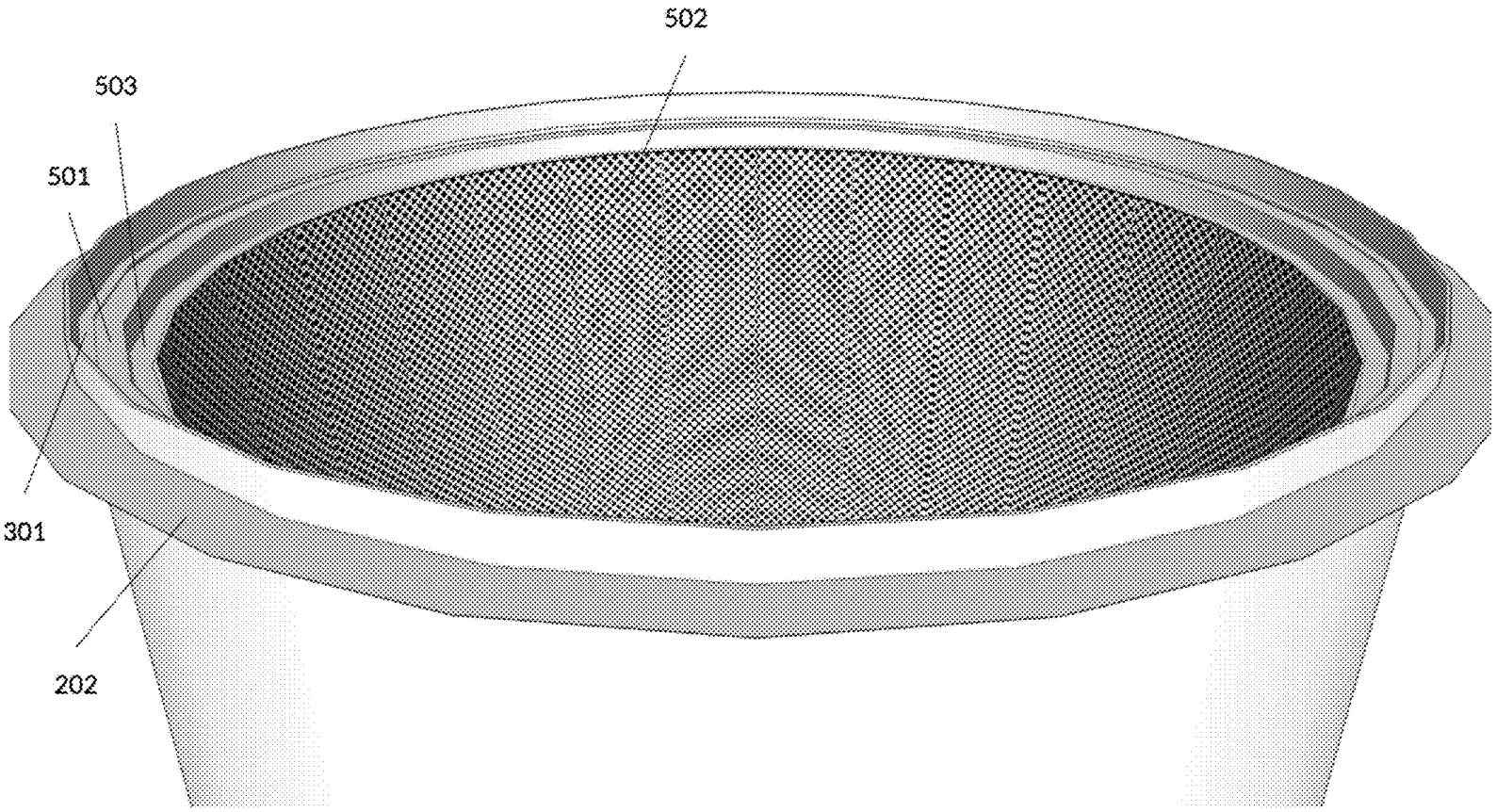
FIG. 6 is a perspective view of frame and inserted basket.

For further illustration of the filtration system, FIG. 6, shows a perspective view of frame and inserted basket.

Figure 7:
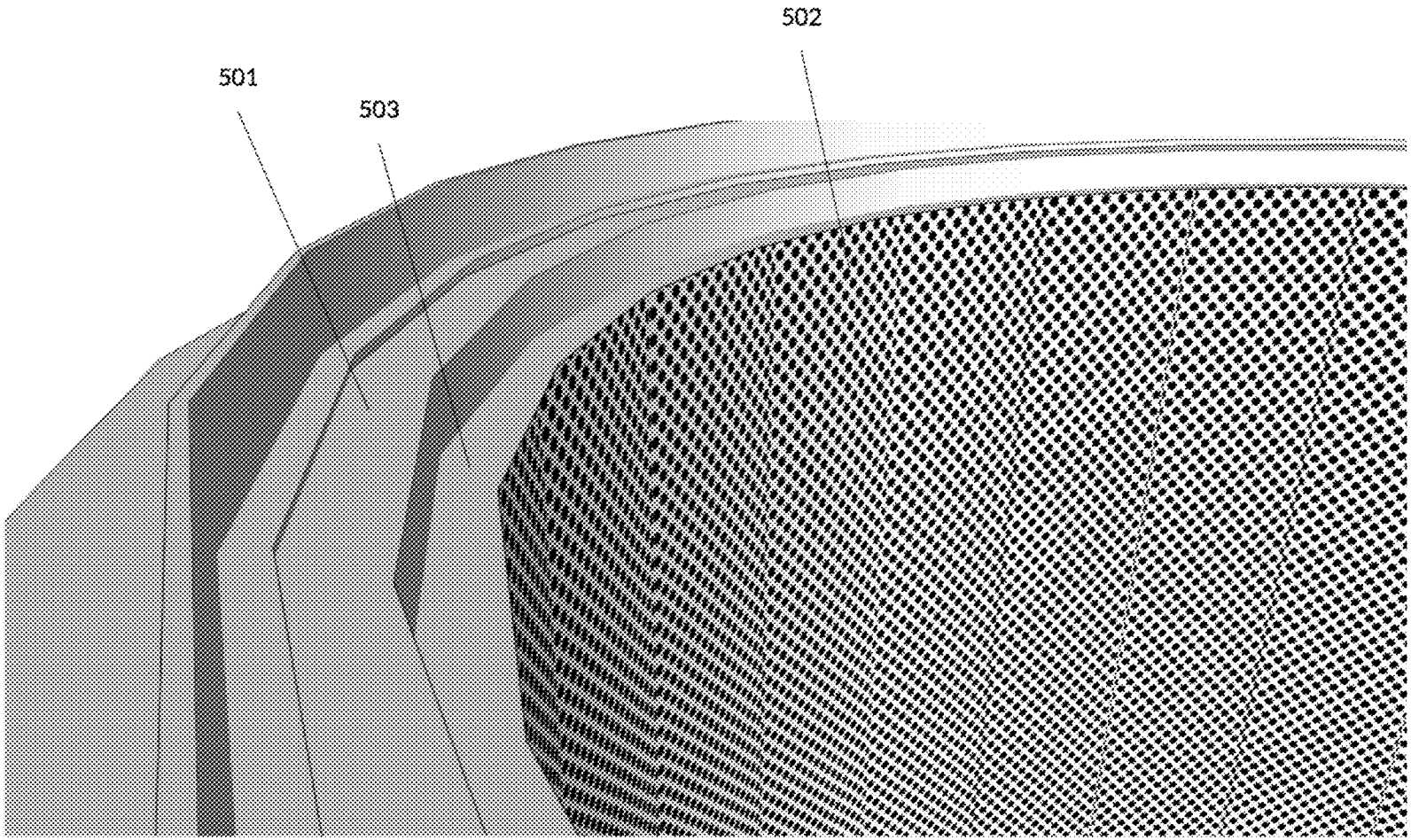
FIG. 7 is a perspective view of frame and inserted basket and contact point between the basket ledge and the basket.

For further illustration of the filtration system, FIG. 7, shows a perspective view of frame and inserted basket and contact point between the basket ledge and the basket.

Figure 8:
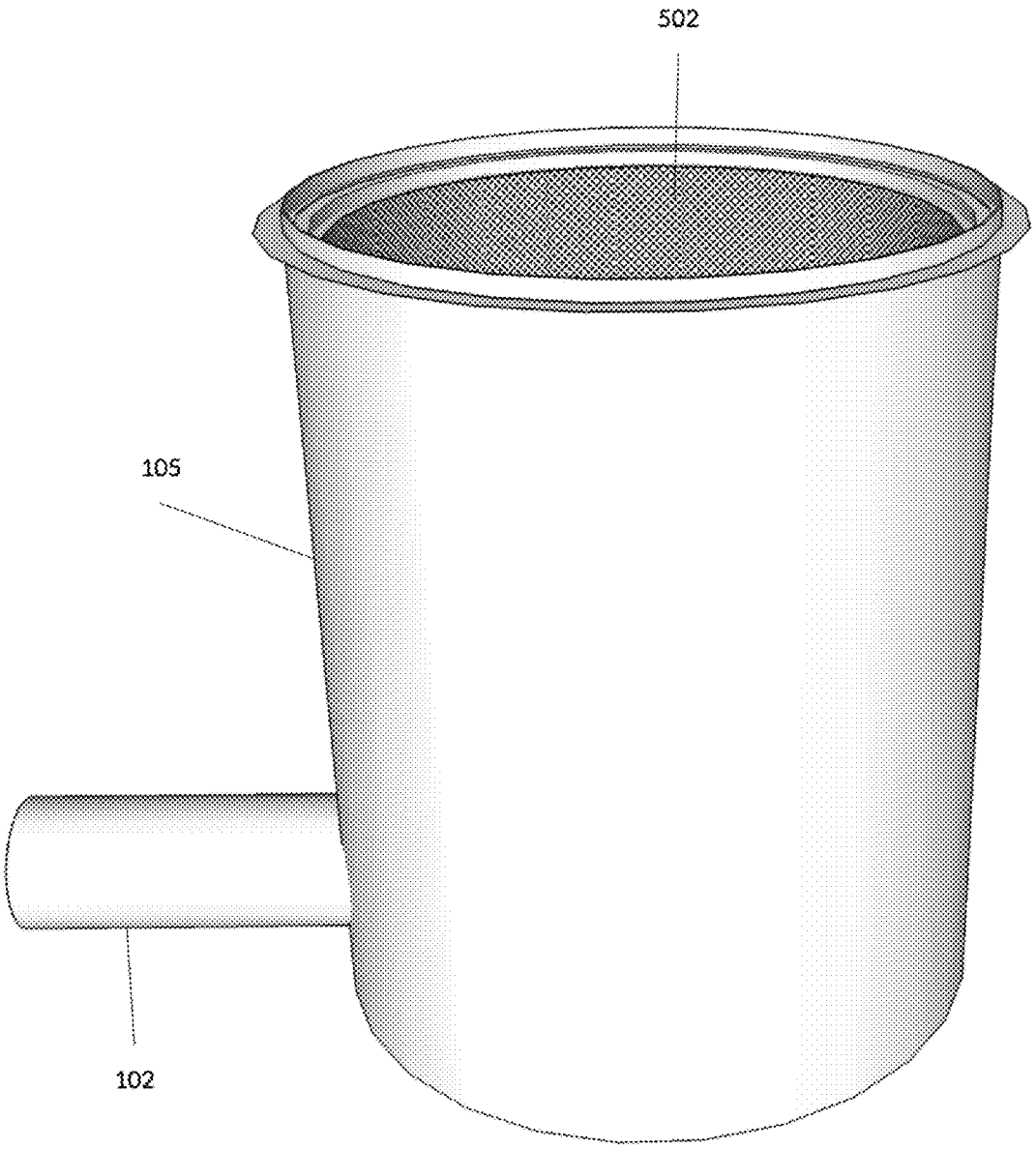
FIG. 8 is a perspective view of catch basin with inserted basket.

For further illustration of the filtration system, FIG. 8, shows a perspective view of catch basin with inserted basket.

Figure 9:
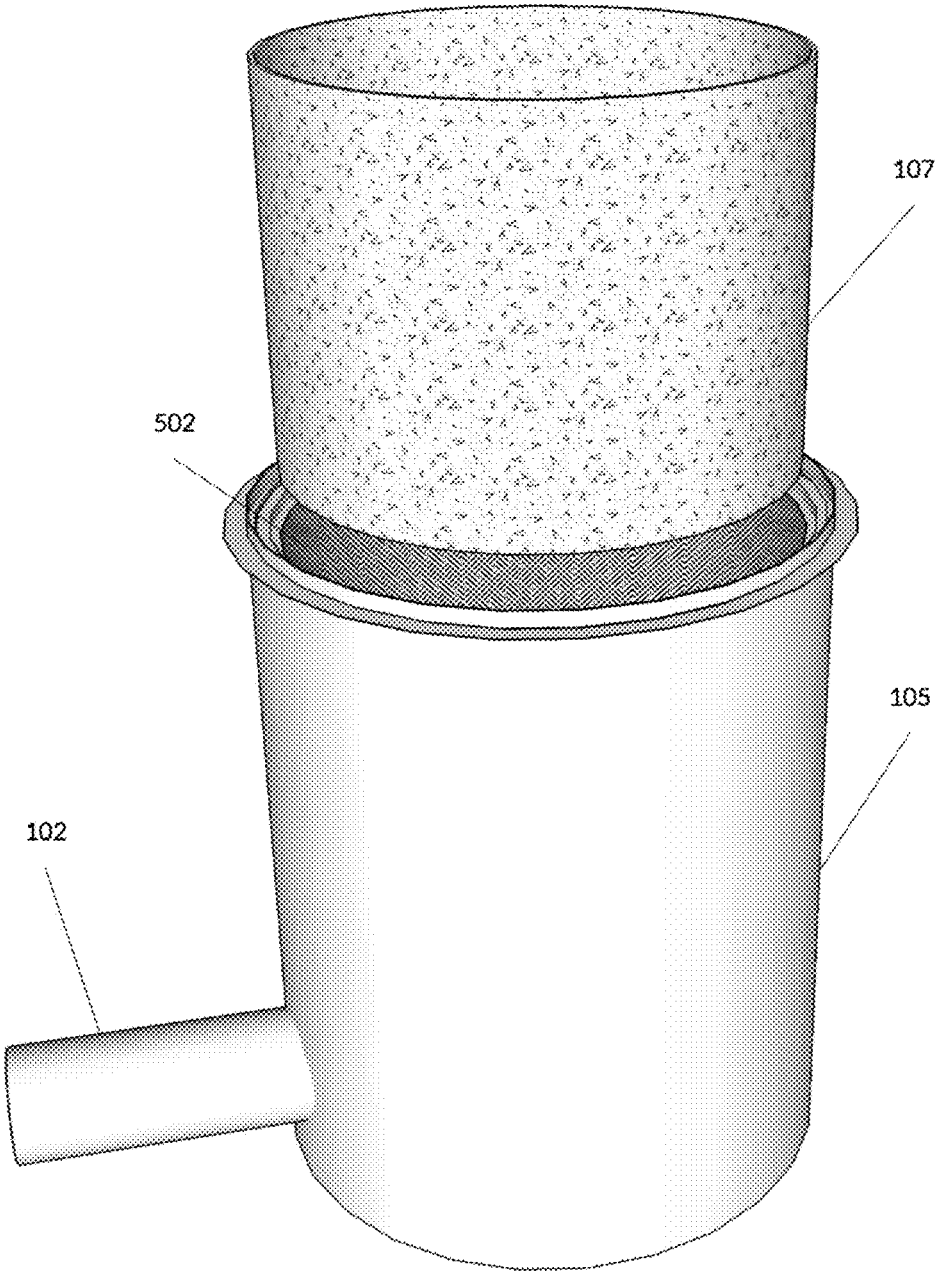
FIG. 9 is an exploded view of catch basin with basket inserted with filter media to be inserted into basket.

For further illustration of the filtration system, FIG. 9, shows an exploded view of catch basin with basket inserted with filter media to be inserted into basket.

Figure 10:
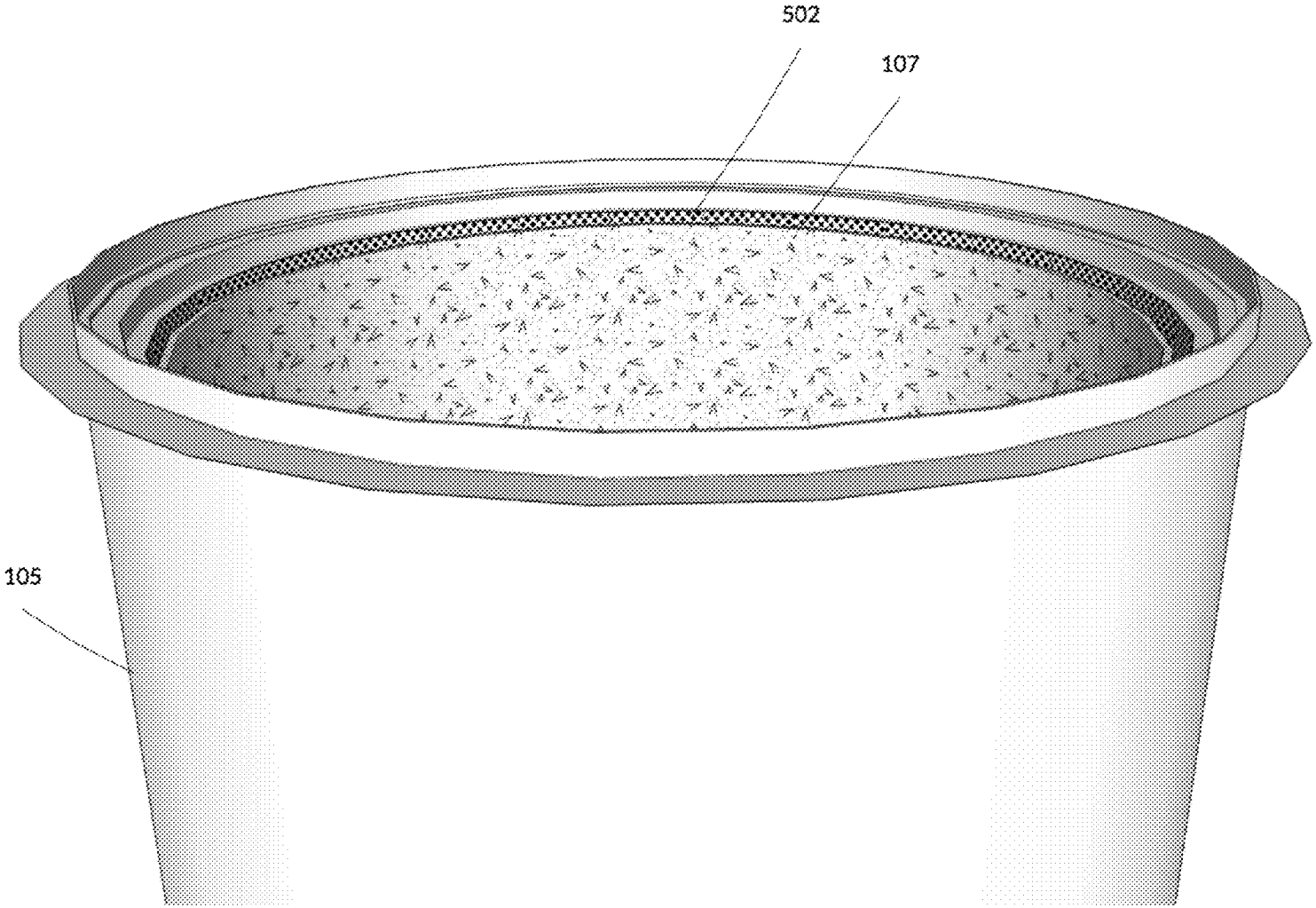
FIG. 10 is a perspective view of catch basin with inserted basket and filter.

For further illustration of the filtration system, FIG. 10, shows a perspective view of catch basin with inserted basket and filter.

Figure 11:
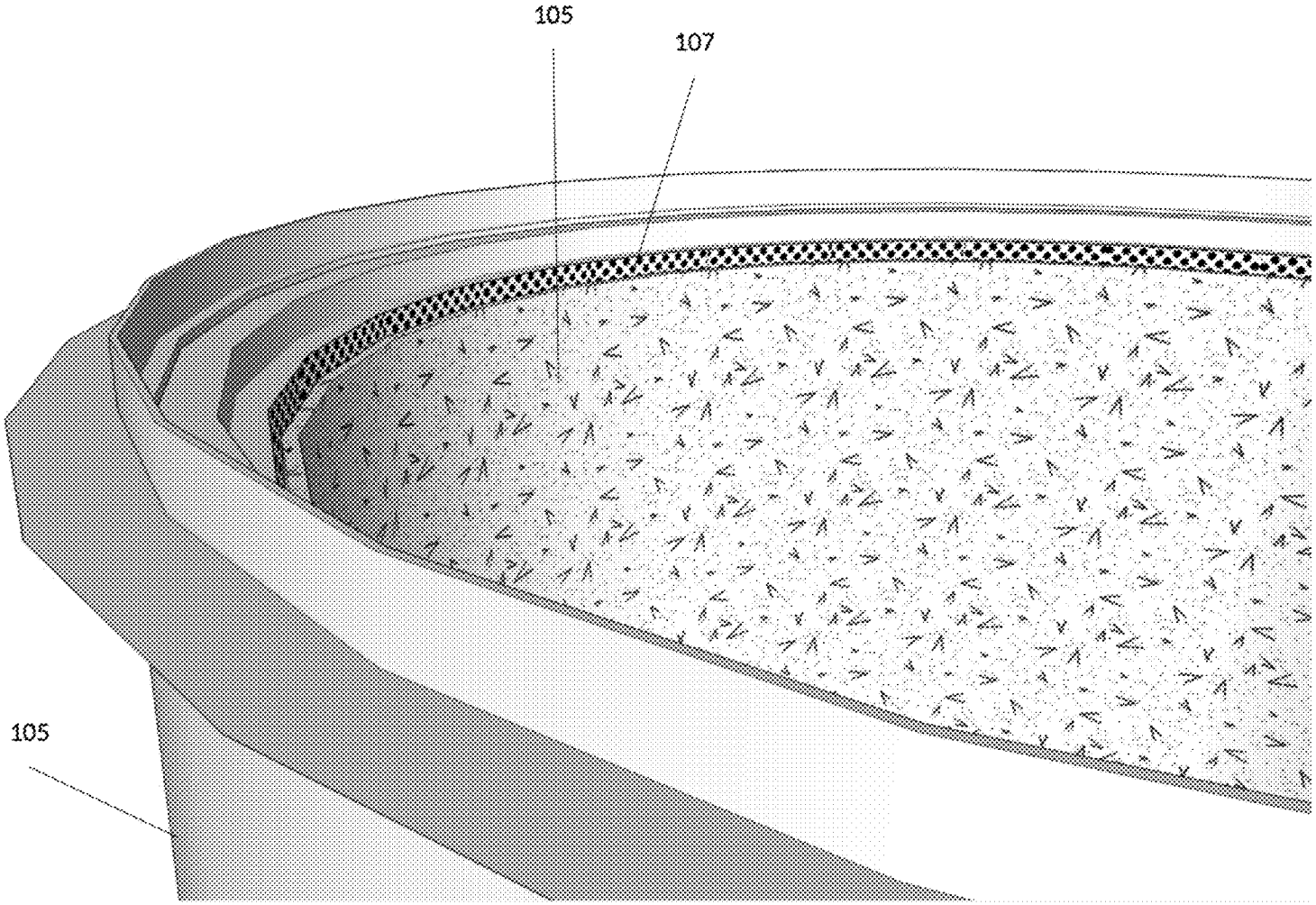
FIG. 11 is a perspective view of catch basin with inserted basket and filter media showing the sewer seal ledge.

For further illustration of the filtration system, FIG. 11, shows a perspective view of catch basin with inserted basket and filter media showing the sewer seal ledge.

Figure 12:
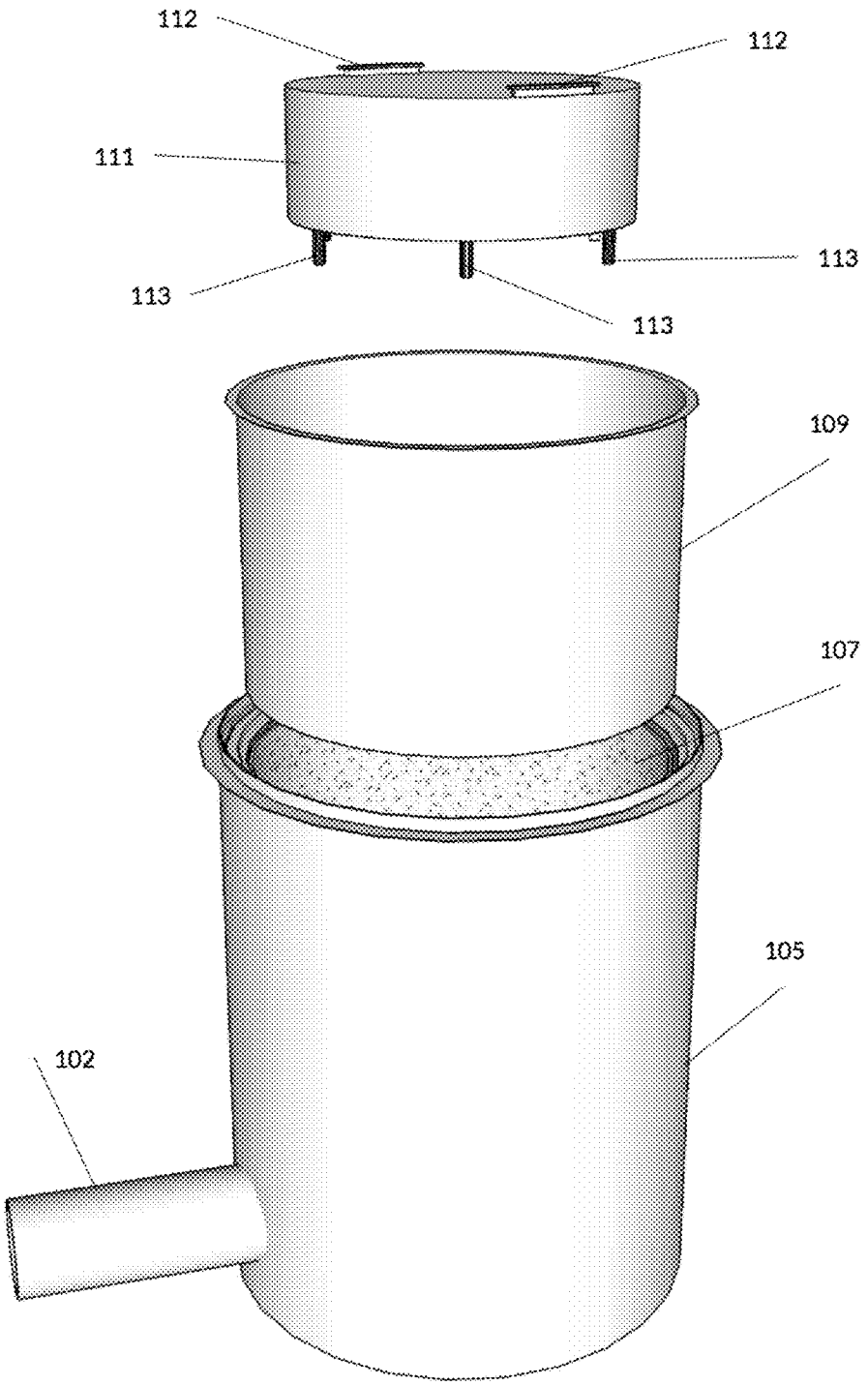
FIG. 12 is an exploded view of assembled catch basin with sewer seal components exploded above.

For further illustration of the filtration system, FIG. 12, shows an exploded view of assembled catch basin with sewer seal components exploded above.

Figure 13:
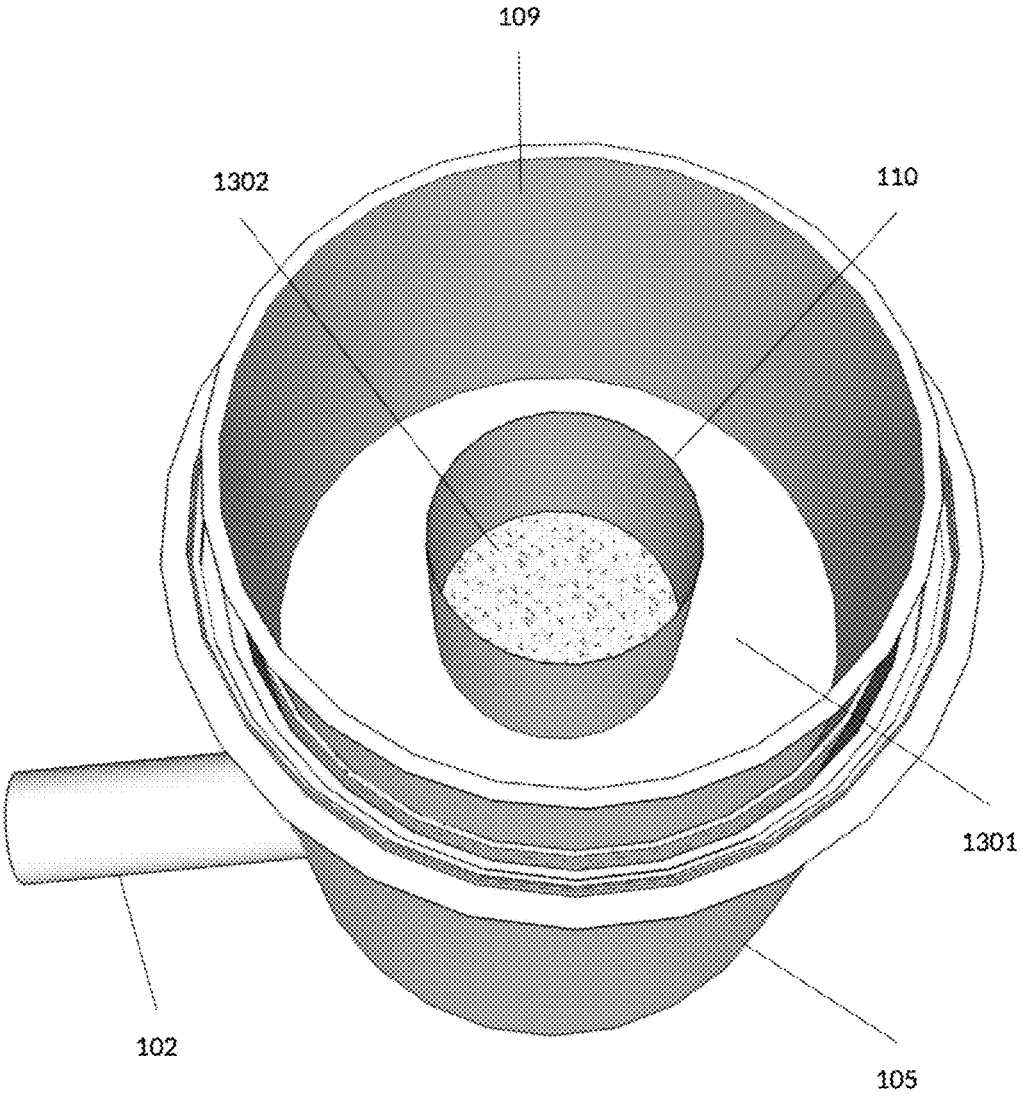
FIG. 13 is an exploded view of catch basin assembly and sewer seal upper chamber partially inserted showing weir and internal components.

Referring now to FIG. 13, which shows an exploded view of catch basin assembly and sewer seal upper chamber partially inserted showing weir and internal components. In some embodiments, upper chamber annulus 1301 comprises the negative space within the upper chamber 109 that helps to form the water seal when combined with the cap 111 and in static conditions, should be level with top of overflow weir 110.

In some embodiments, the volume of upper chamber annulus 1301 can be determined by the flow rate dynamics of the linked underground piping system 102 flow rate. In some embodiments, the diameter of upper chamber annulus 1301 may range from a minimum of 10 inches to a maximum of 60 inches.

Upper chamber annulus 1301 functions to both 1) hold residual water in static conditions, thereby forming a water seal, and to 2) create the outer annulus 1801 and inner annulus 1701 when cap 111 is in place. Upper chamber annulus 1301 is preferably shaped like a circle or donut-shaped; however, it is thought that in alternative embodiments, that it may also be shaped like a rectangle or alternately, square-shaped. In some embodiments, upper chamber annulus 1301 is split and forms an outer annulus 1801 and inner annulus 1701.

At the top of the overflow weir 110, is the upper chamber flow aperture 1302. I some embodiments, the upper chamber flow aperture 1302 comprises the hole in the overflow weir 110 that empties into filter basket 106 and through which water flows. Upper chamber flow aperture 1302 is preferably shaped like the shape of overflow weir 110.

Figure 14:
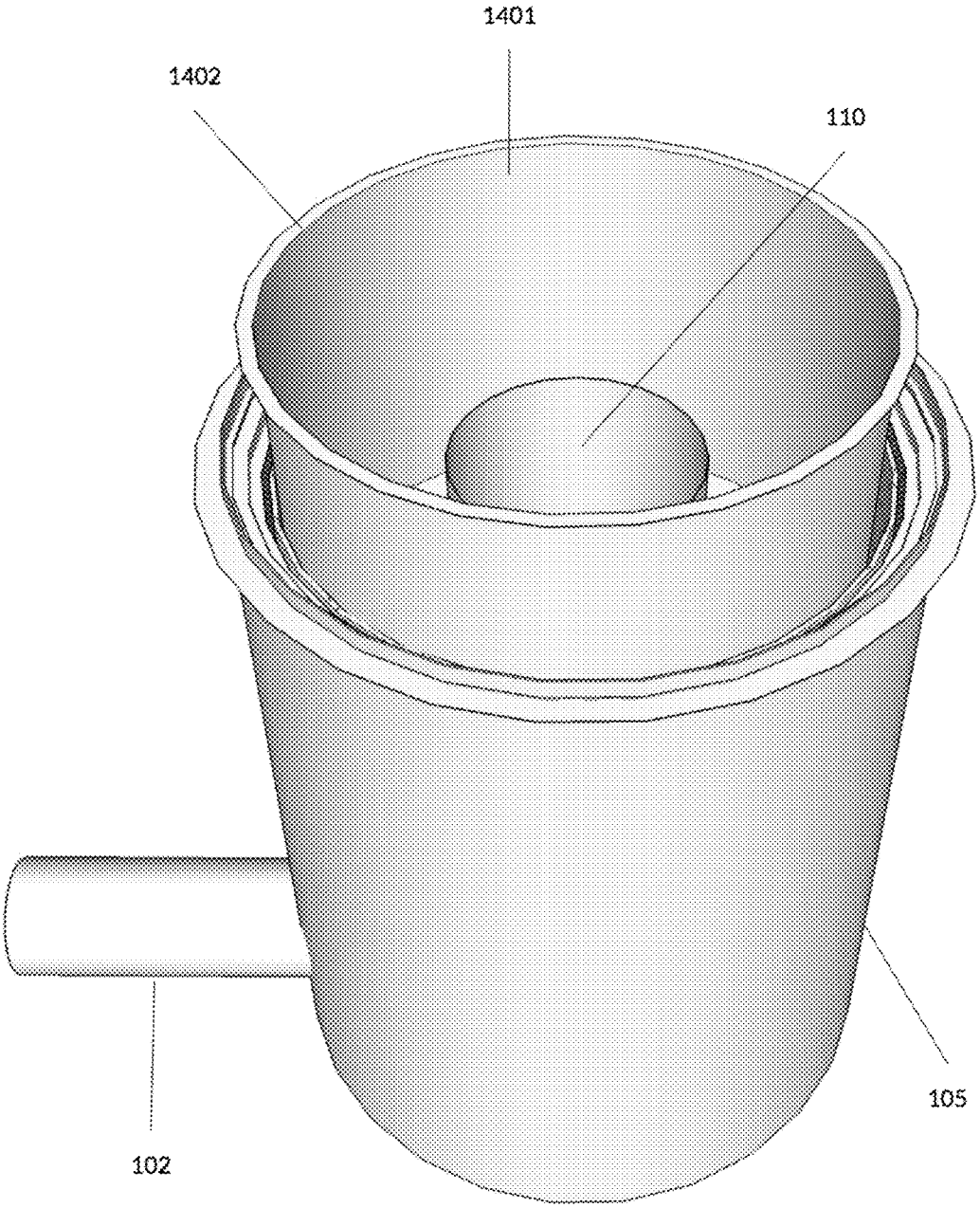
FIG. 14 is an exploded view of catch basin and upper chamber of sewer seal inserted into the basin.

Referring now to FIG. 14, which shows an exploded view of catch basin and upper chamber of sewer seal inserted into the basin. In some embodiments, upper chamber outer wall 1401 comprises a structure that encompasses the upper chamber 109 forming its structure. Spatially, upper chamber outer wall 1401 is preferably positioned surrounding cap 111 and is also preferably shaped like a cylinder.

In some embodiments, the diameter of upper chamber outer wall 1401 can be determined by the preferred flow rate of the system. One goal of upper chamber outer wall 1401 is to form part of the upper chamber annulus 1301 along with the cap.

In some embodiments, upper chamber flange 1402 comprises a brim or lip on the upper chamber 109 that is preferably positioned sitting on sewer seal ledge 503 of filter basket 106. Upper chamber flange 1402 is mainly thought to be composed of stainless steel and have a preferred width of 1 3/16" inches but in some embodiments, may range from a minimum of ½ inches to a maximum width of 3 inches. In some embodiments, the width of upper chamber flange 1402 can be calculated by corresponding with sewer seal ledge 503. In some embodiments, upper chamber flange 1402 has a preferred thickness of ⅛ inches but in some embodiments, may range from a minimum of 1/32 inches to a maximum thickness of 3 inches. In some embodiments, the upper chamber flange 1402 may be supported by one or more gussets.

Figure 15:
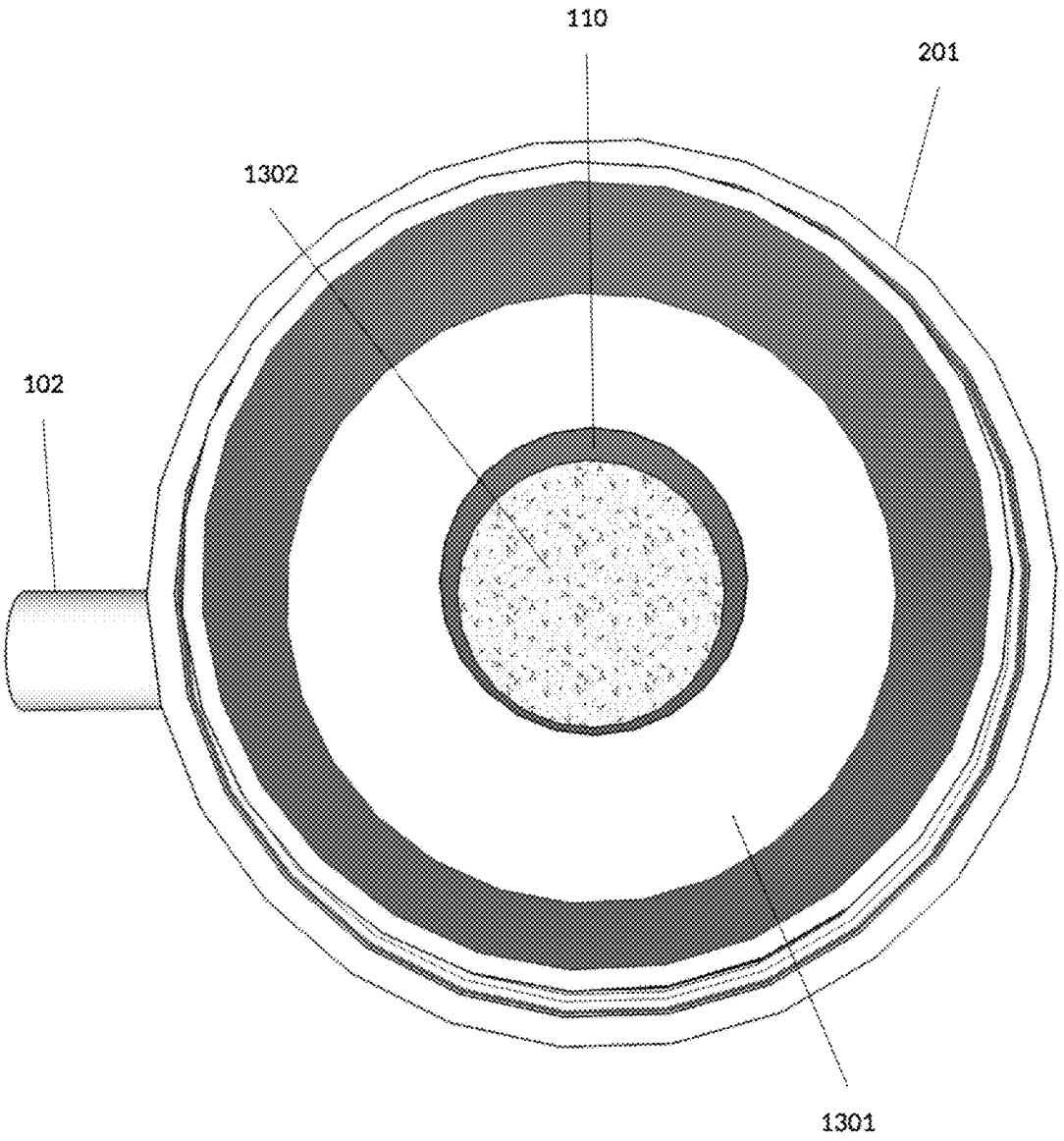
FIG. 15 is a bird's eye view of the sewer seal upper chamber inserted into the catch basin.

For further illustration of the filtration system, FIG. 15, which shows a bird's eye view of the sewer seal upper chamber inserted into the catch basin.

Figure 16:
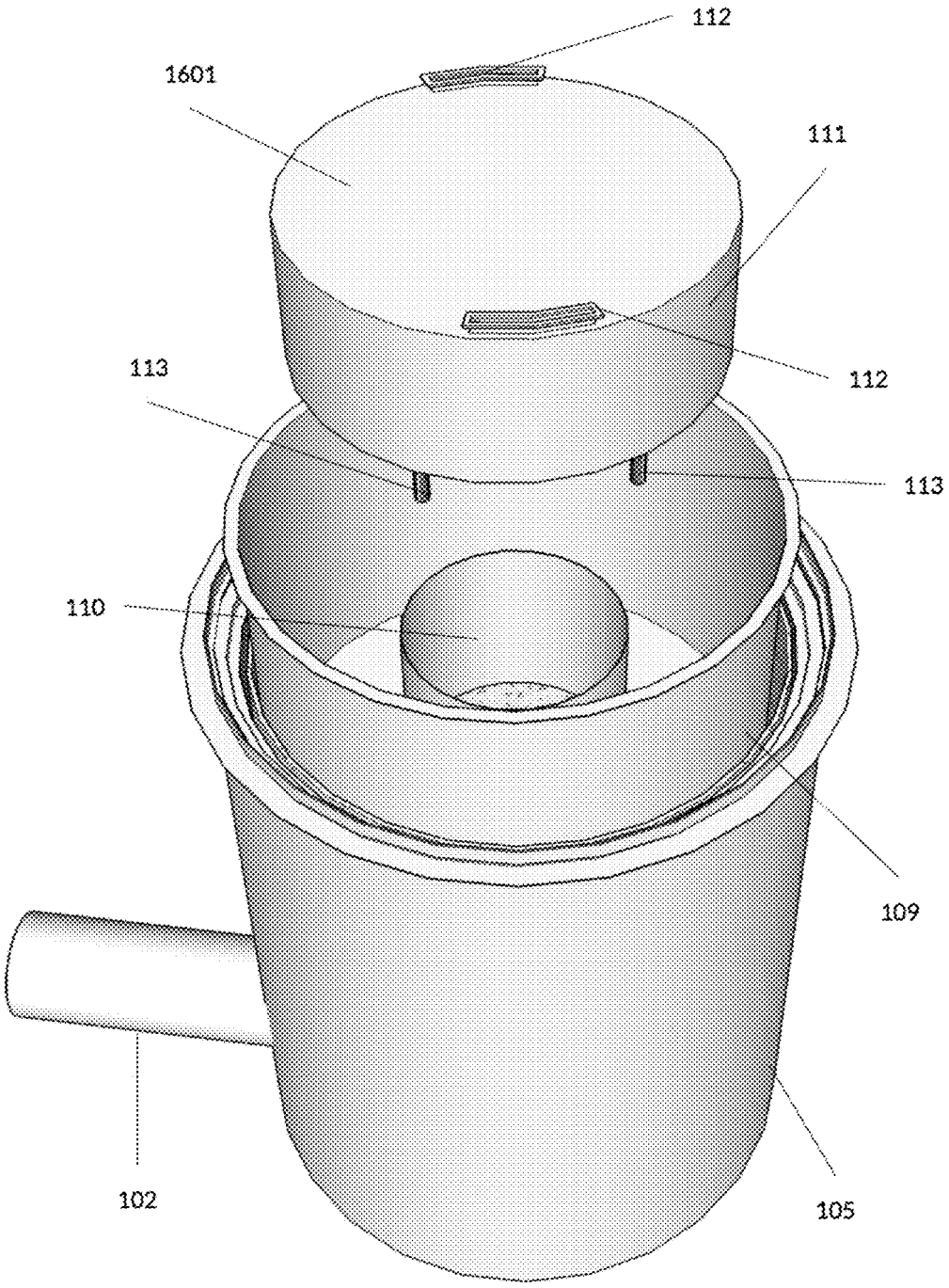
FIG. 16 is an exploded view of the assembled catch basin and sewer seal cap that configures to interact with the upper chamber.

Referring now to FIG. 16, which shows an exploded view of the assembled catch basin and sewer seal cap that configures to interact with the upper chamber. Cap top 1601 comprises the lid of cap 111. One goal of cap top 1601 is to help form the water seal.

Figure 17:
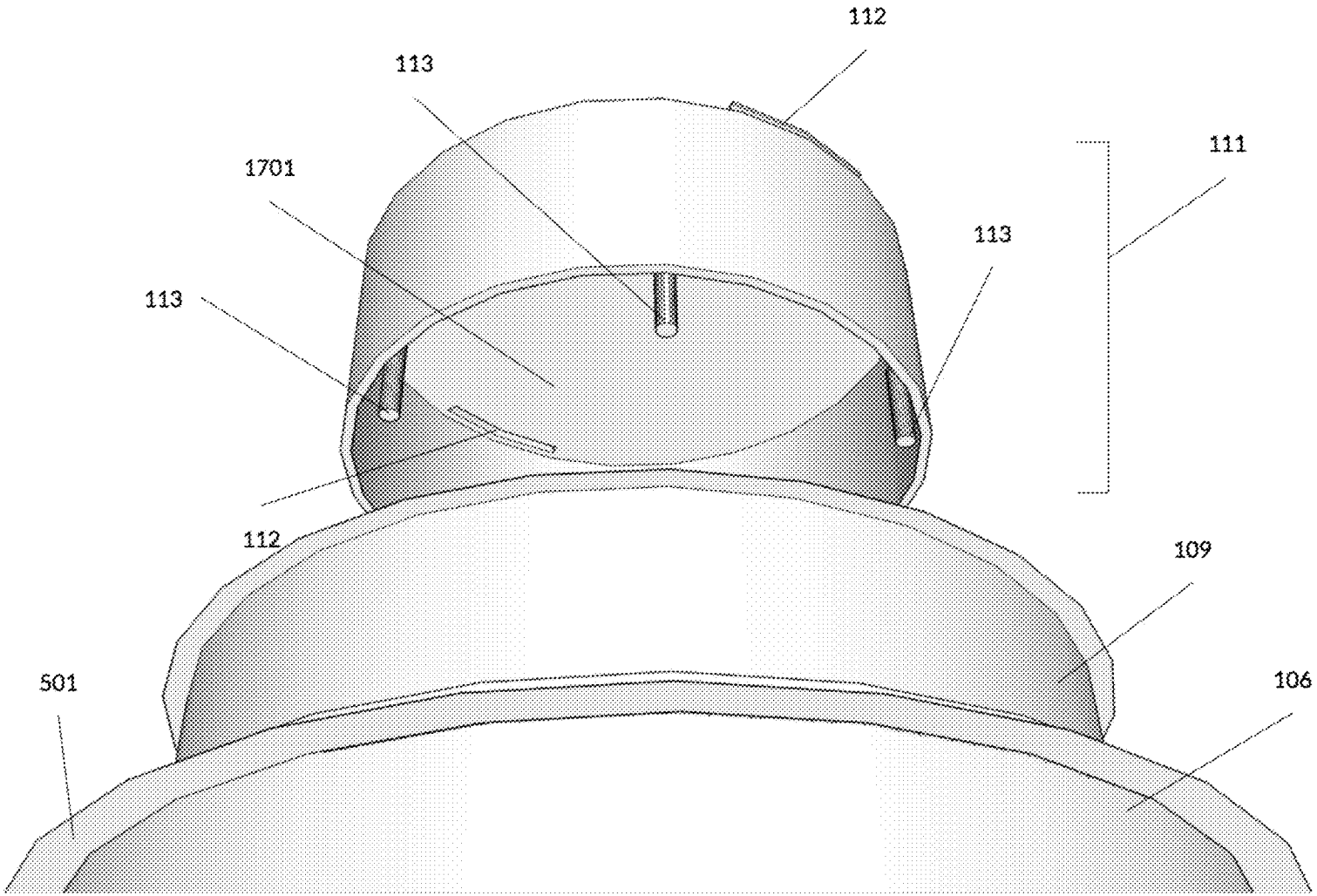
FIG. 17 is a perspective view showing the bottom of the sewer seal cap and legs.

Referring now to FIG. 17, which shows a perspective view showing the bottom of the sewer seal cap and legs. In some embodiments, inner annulus 1701 comprises a space formed central to the outer annulus 1801, between overflow weir 110 and cap 111 wall, which holds water.

Figure 18:
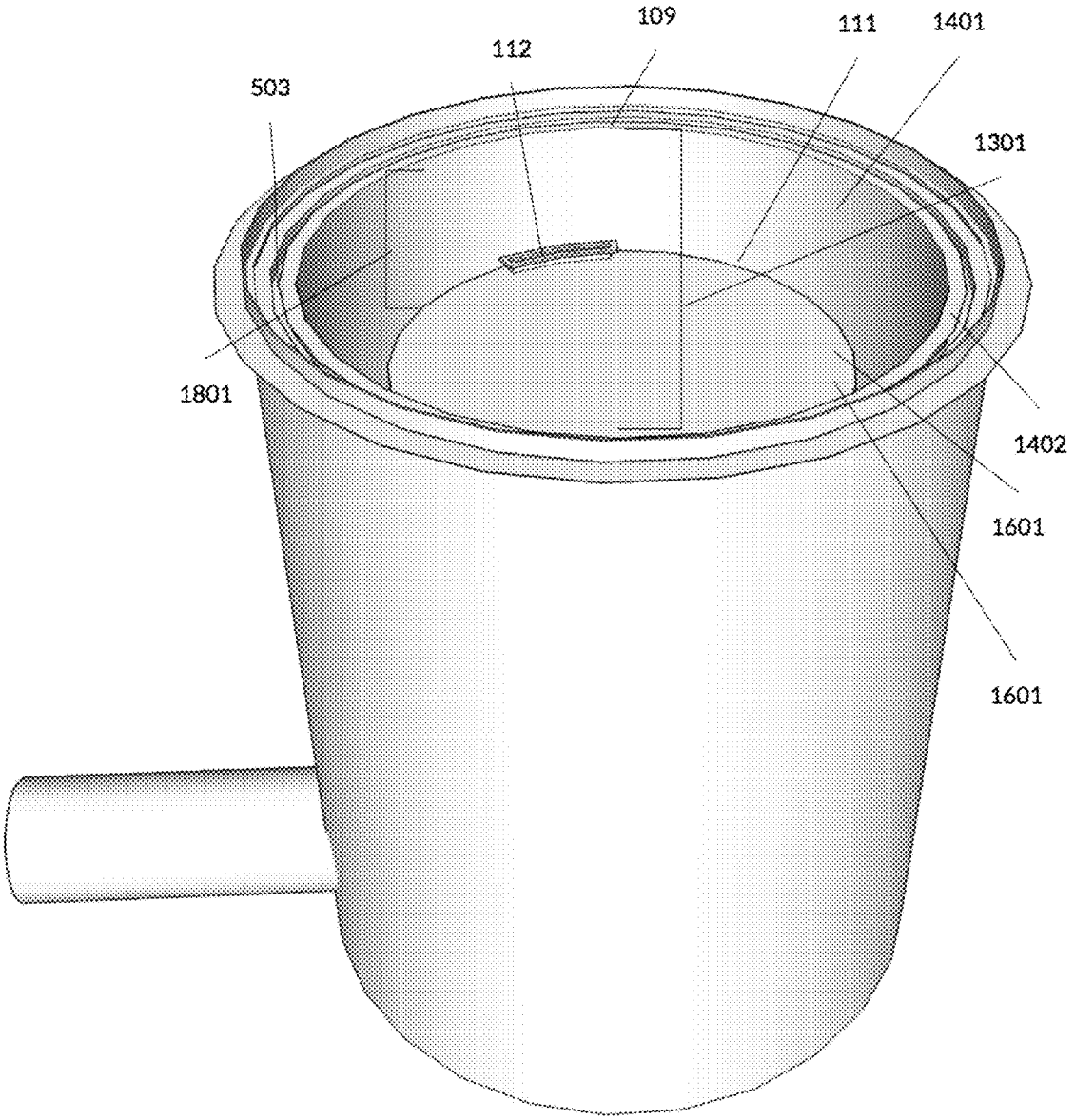
FIG. 18 is a perspective view of the assembled catch basin with sewer seal inserted.

Referring now to FIG. 18, which shows a perspective view of the assembled catch basin with sewer seal inserted. In some embodiments, outer annulus 1801 comprises a space formed peripheral to inner annulus 1701, between upper chamber outer wall 1401 and cap 111 wall, which combines with the inner annulus to hold water and form the seal.

Figure 19:
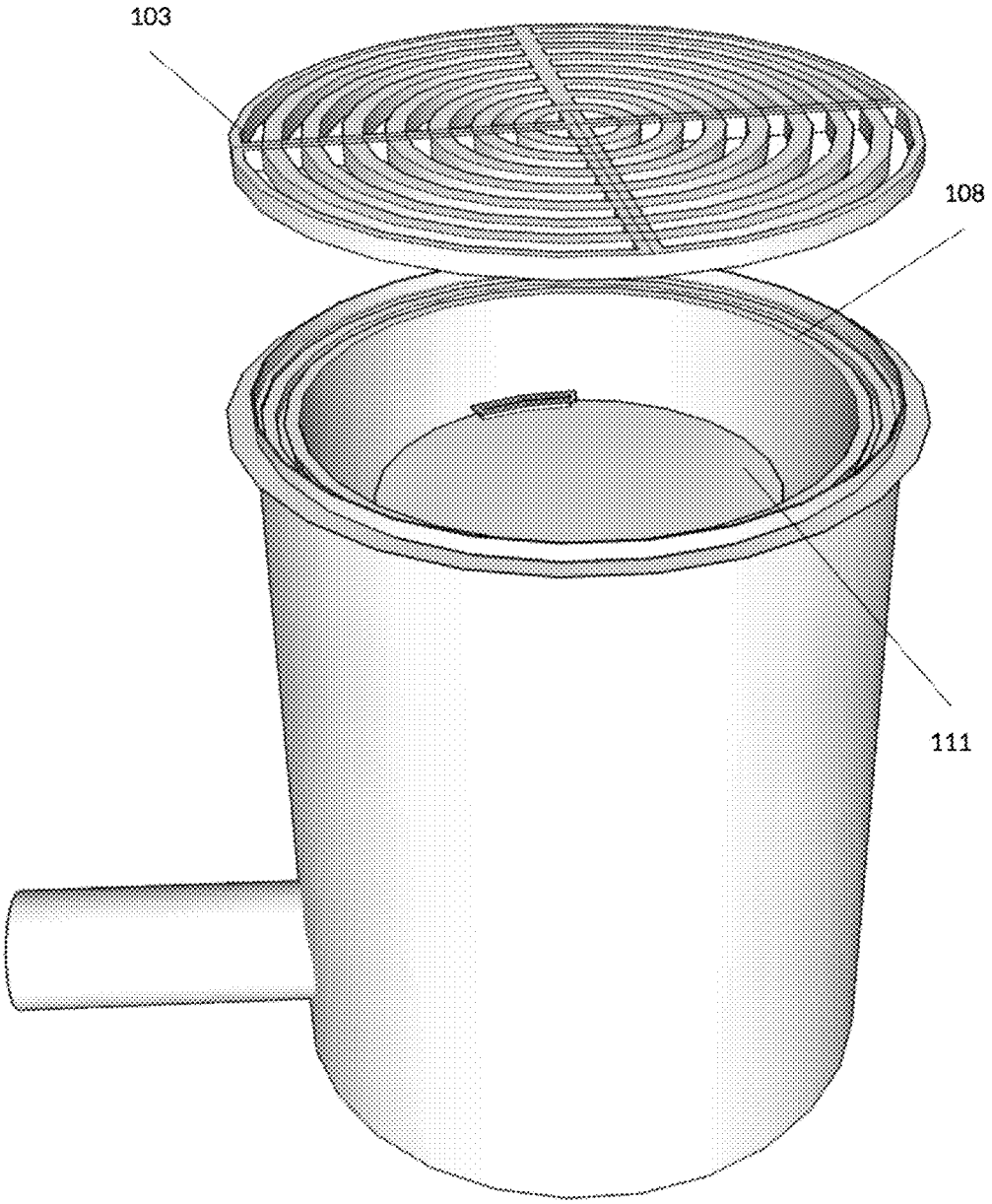
FIG. 19 is an exploded view of assembled components with catch basin and grate to be inserted on the grate ledge of the frame.

For further illustration of the filtration system, FIG. 19, which shows an exploded view of assembled components with catch basin and grate to be inserted on the grate ledge of the frame.

Figure 20:
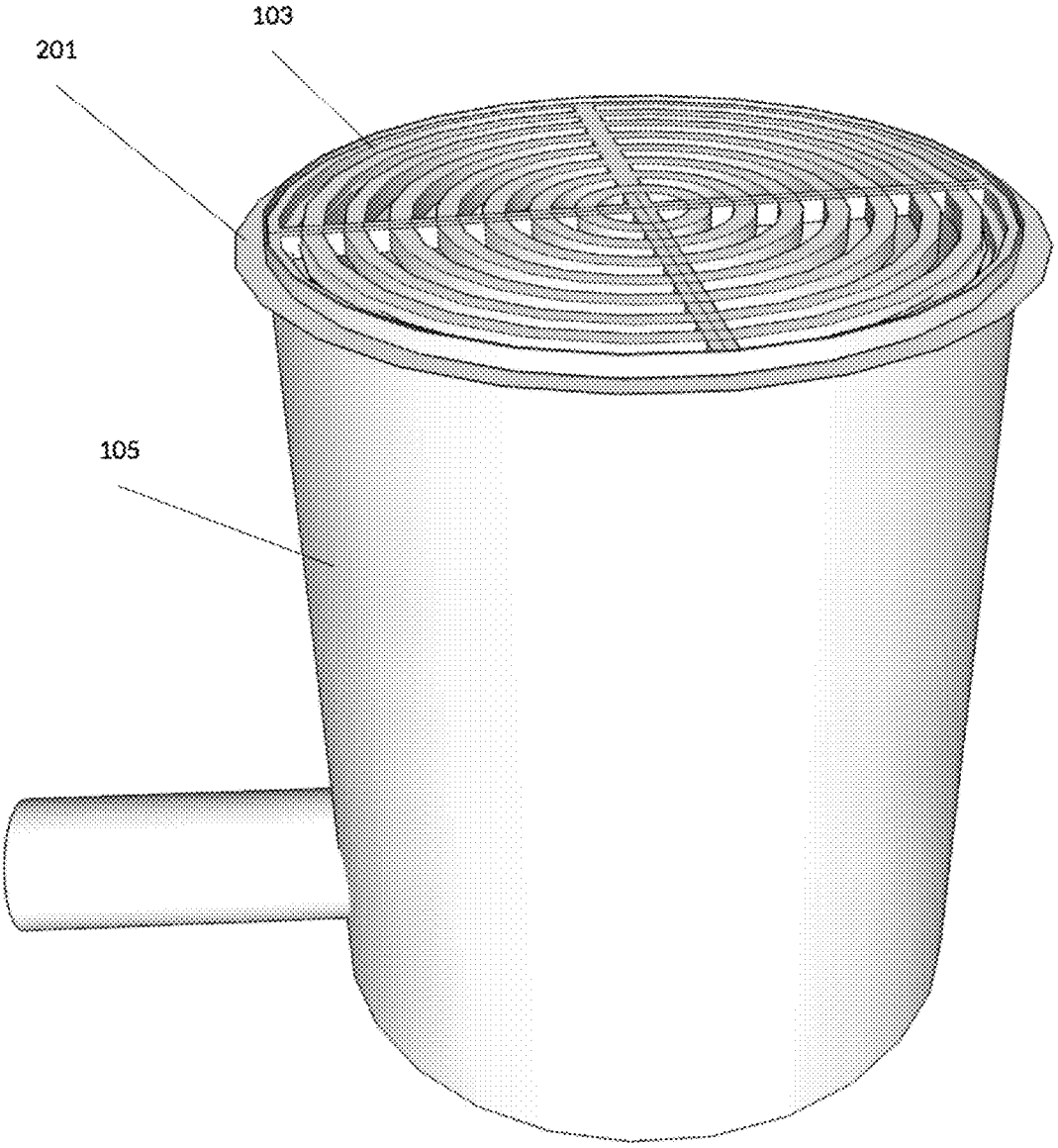
FIG. 20 is a perspective view of the grate assembled with the catch basin resting on the grate ledge of the frame.

For further illustration of the filtration system, FIG. 20, which shows a perspective view of the grate assembled with the catch basin resting on the grate ledge of the frame.

Figure 21:
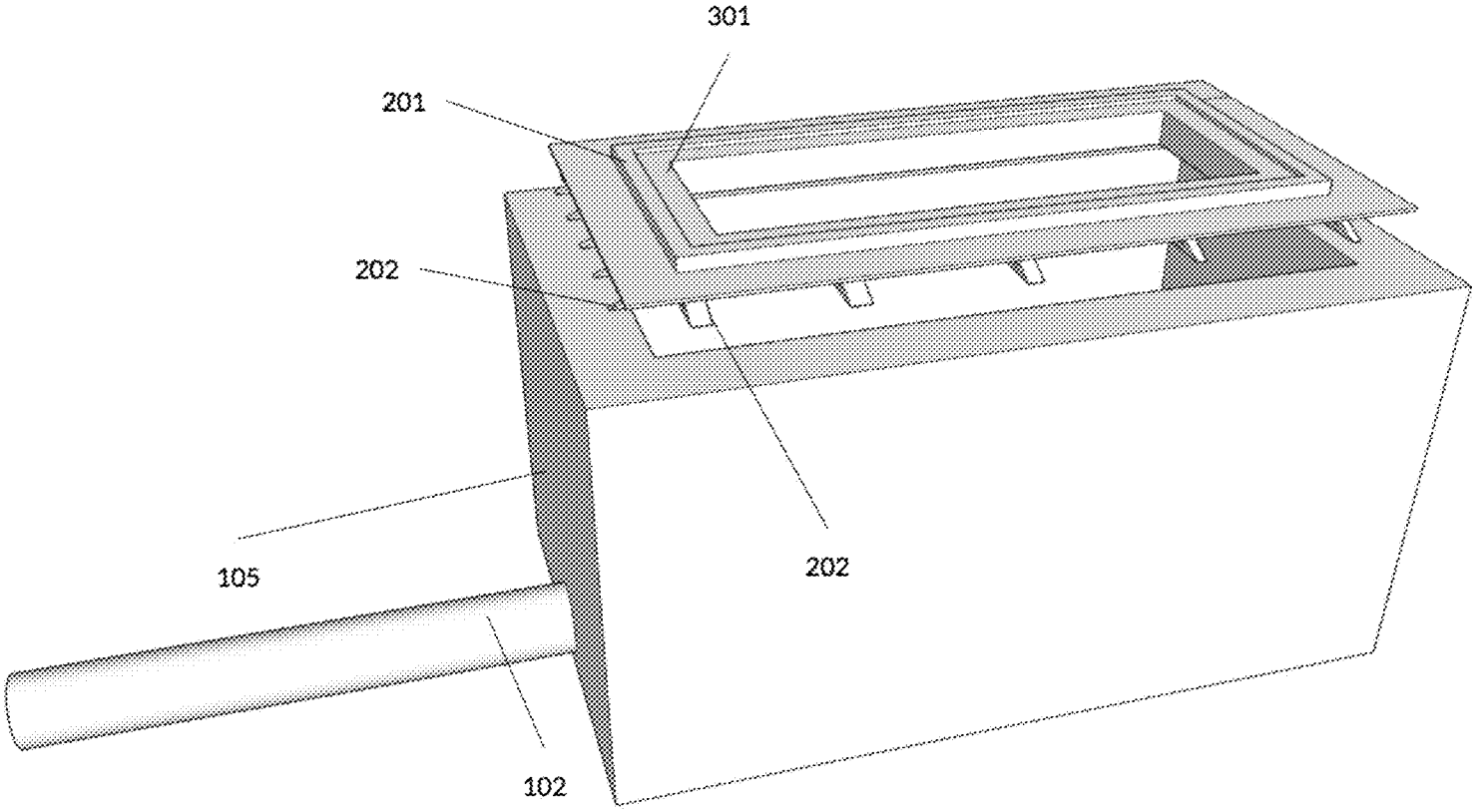
FIG. 21 is an exploded view of embodiment of filtration system where grate is separate piece and is reconfigured to attach to existing catch basin.

For further illustration of the filtration system, FIG. 21, which shows an exploded view of embodiment of filtration system where the grate is separate piece and is reconfigured to attach to existing catch basin.

Figure 22:
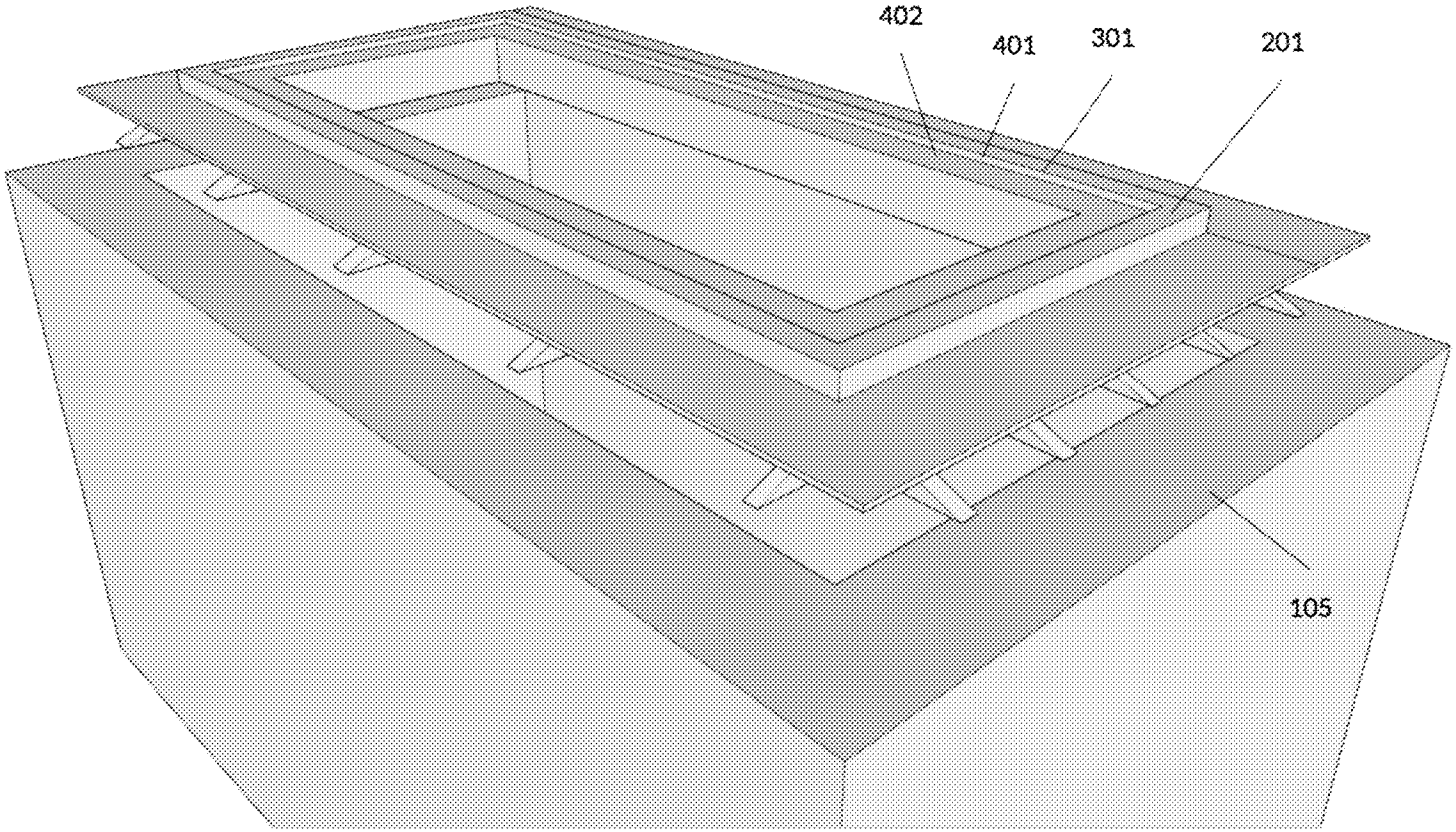
FIG. 22 is an exploded view of embodiment of catch basin where grate is inserted in existing catch basin.

For further illustration of the filtration system, FIG. 22, which shows an exploded view of embodiment of catch basin where grate is inserted in existing catch basin.

Figure 23:
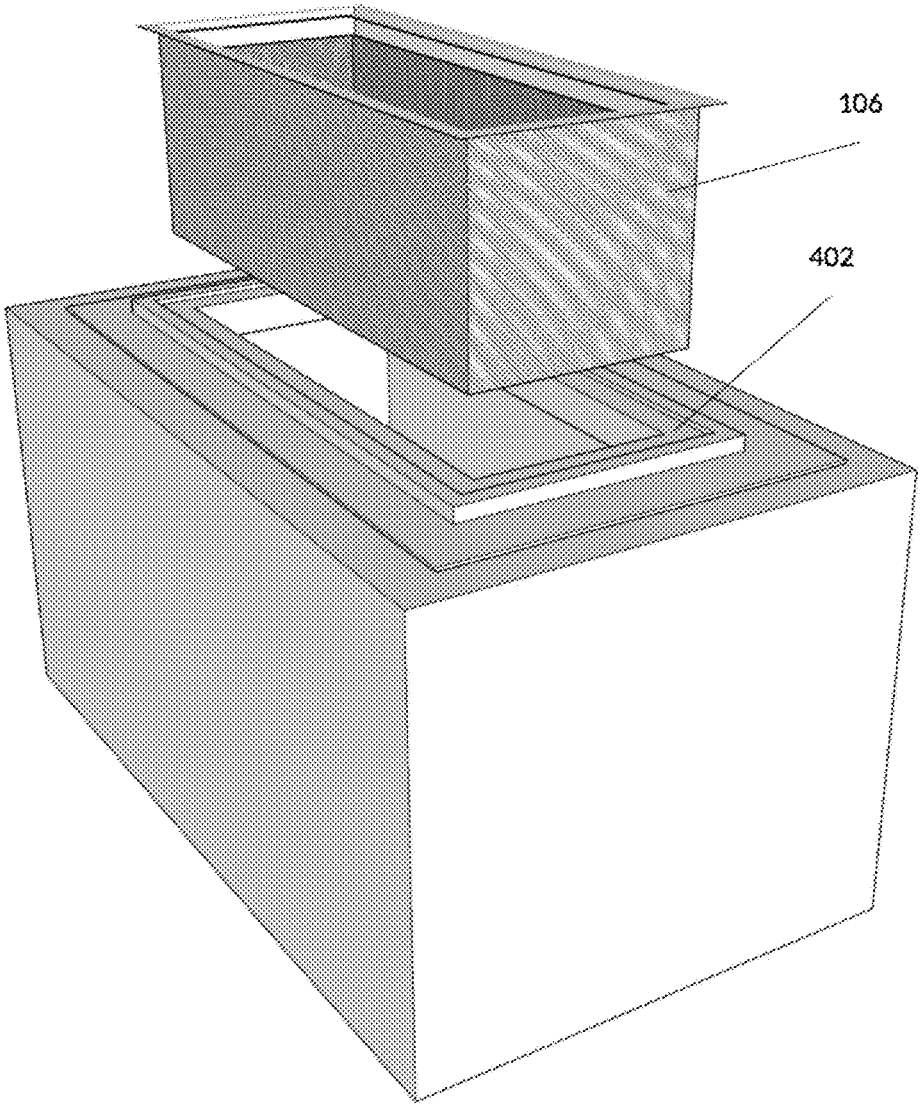
FIG. 23 is an exploded view of embodiment of filtration system where basket is inserted onto a single grate ledge instead of on a basket ledge.

For further illustration of the filtration system, FIG. 23, which shows an exploded view of embodiment of filtration system where basket is inserted onto a single grate ledge instead of on a basket ledge.

Figure 24:
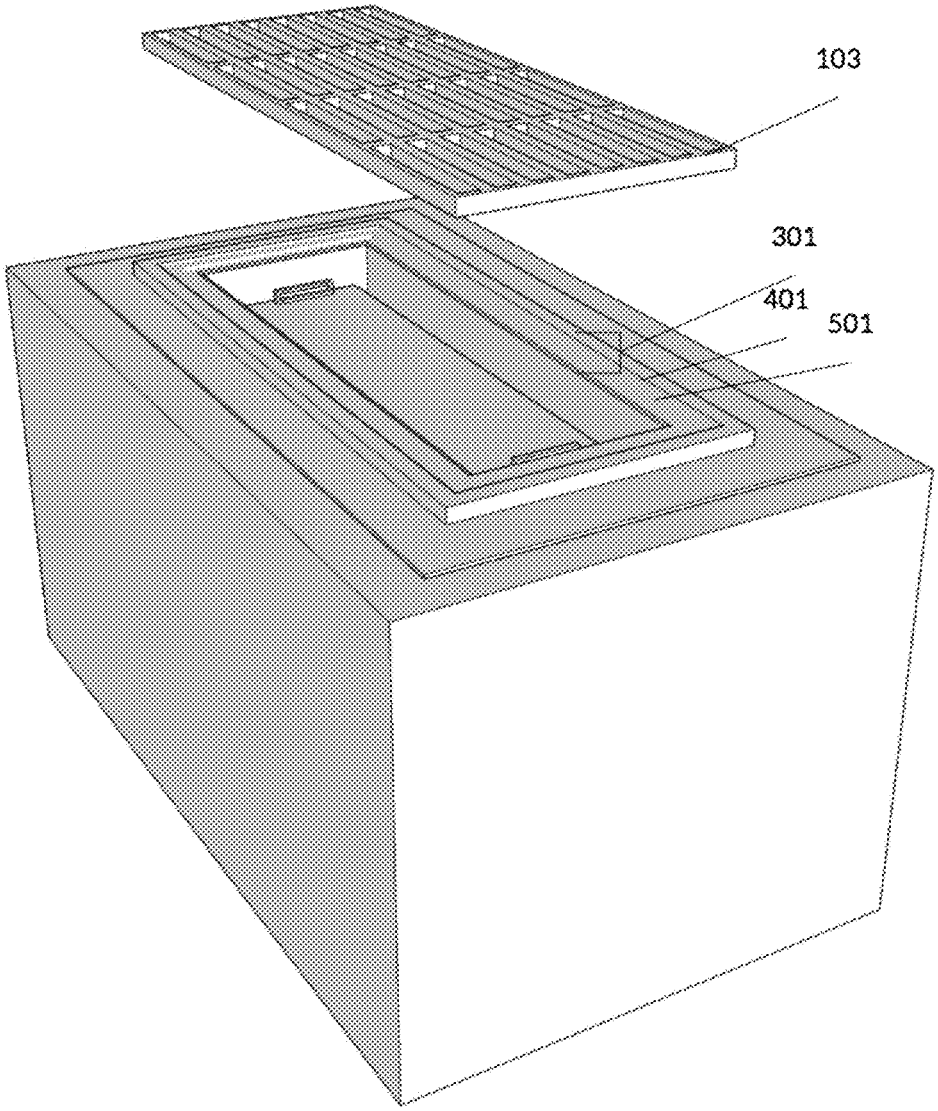
FIG. 24 is an exploded view of embodiment of filtration system where existing grate is added onto the same ledge as the basket on the frame wherein the grate ledge height accommodates the thickness of both pieces to remain flush after the grate and basket are assembled.

For further illustration of the filtration system, FIG. 24, which shows an exploded view of embodiment of filtration system where existing grate is added onto the same ledge as the basket on the frame wherein the grate ledge height accommodates the thickness of both pieces to remain flush after the grate and basket are assembled.

Figure 25:
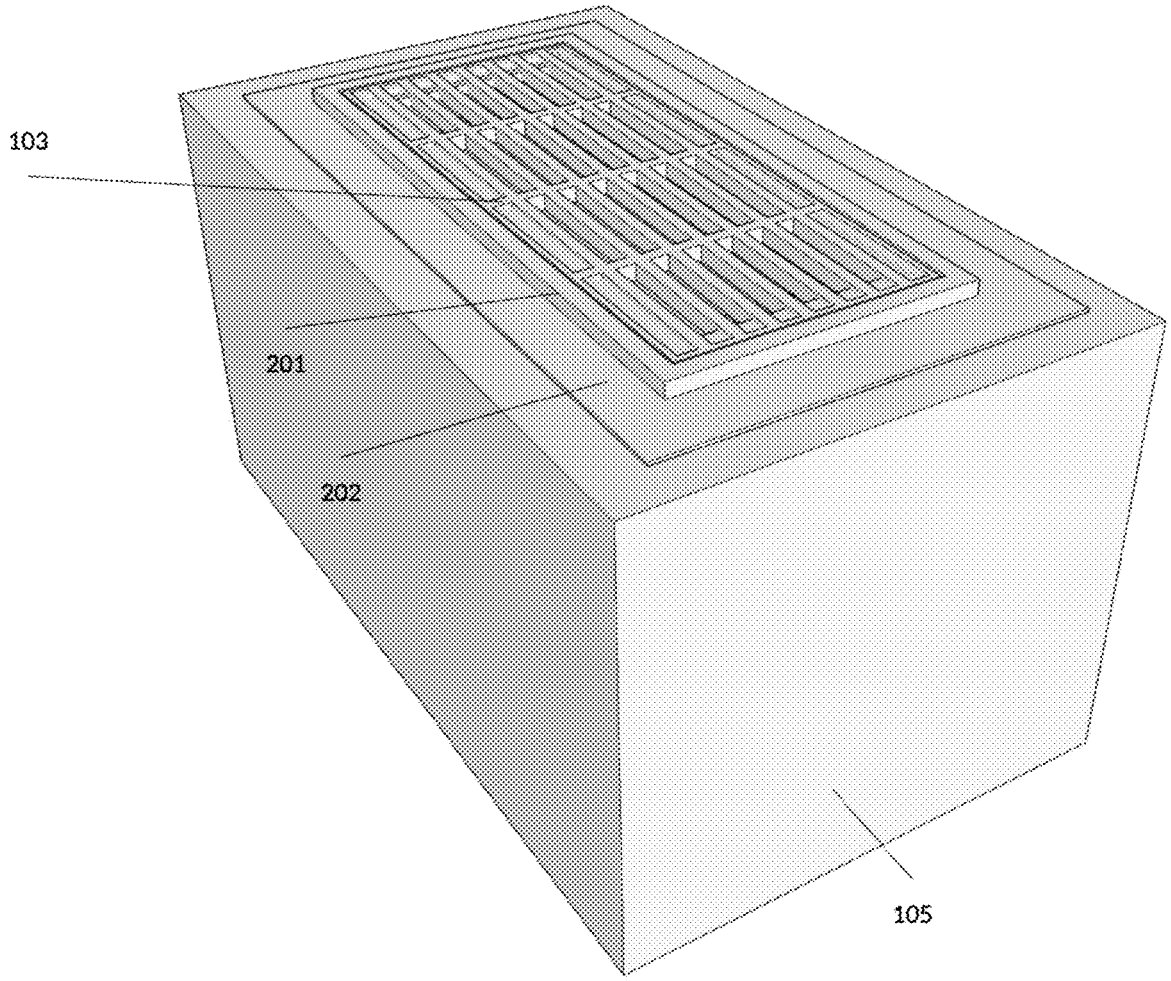
FIG. 25 is an exploded view of embodiment of filtration system where an existing grate and catch basin are repurposed with the system components by using an independent frame.

For further illustration of the filtration system, FIG. 25, which shows an exploded view of embodiment of filtration system where an existing grate and catch basin are repurposed with the system components by using an independent frame.

Figure 26:
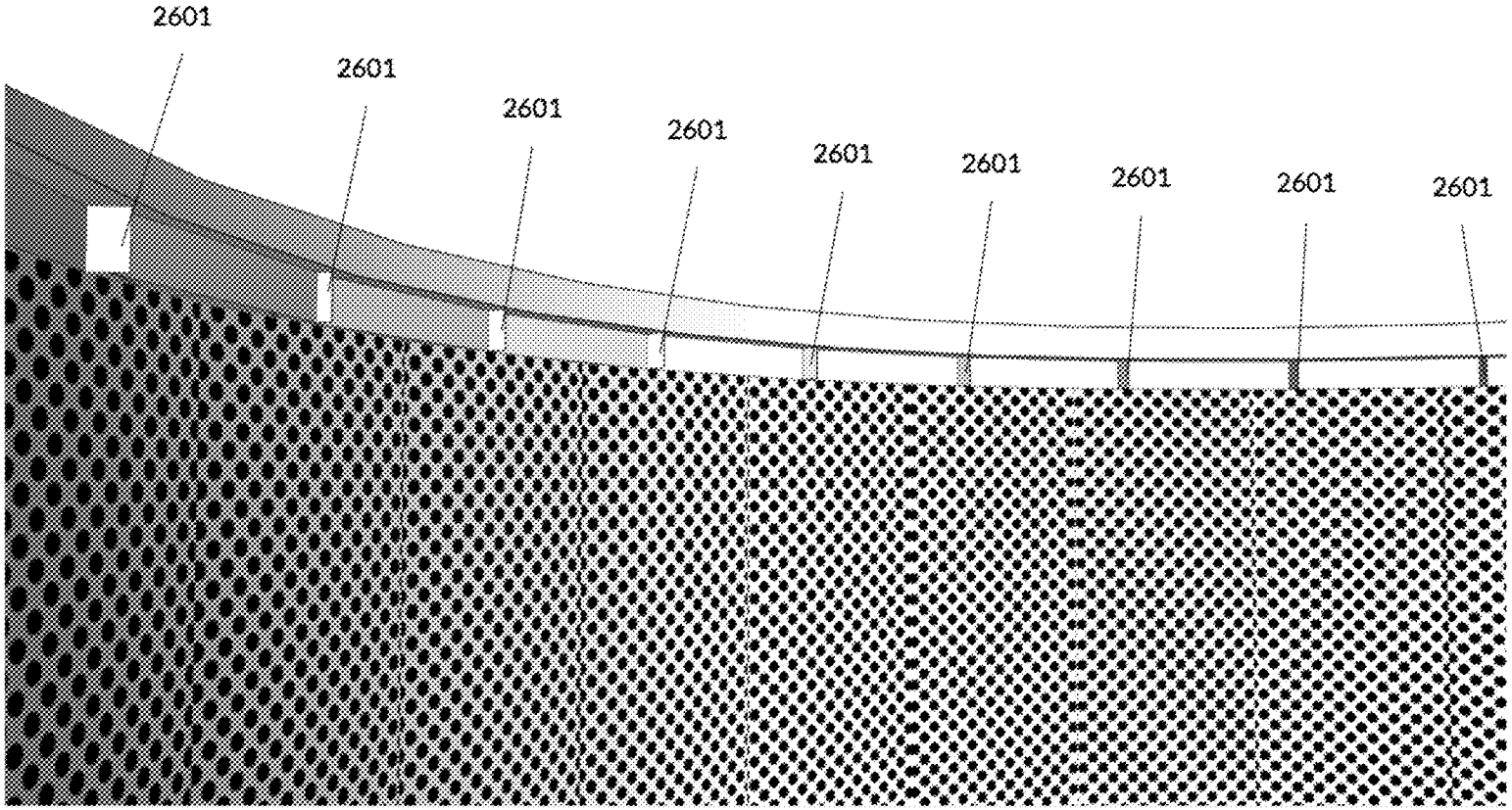
FIG. 26 is an embodiment of the filter basket with sewer seal gusset supports supporting the sewer seal ledge.

For further illustration of the filtration system, FIG. 26, which shows an embodiment of the filter basket with sewer seal gusset supports supporting the sewer seal ledge. In some embodiments, sewer seal gusset support 2601 comprises supports for sewer seal ledge 503 to support weight of system.

Figure 27:
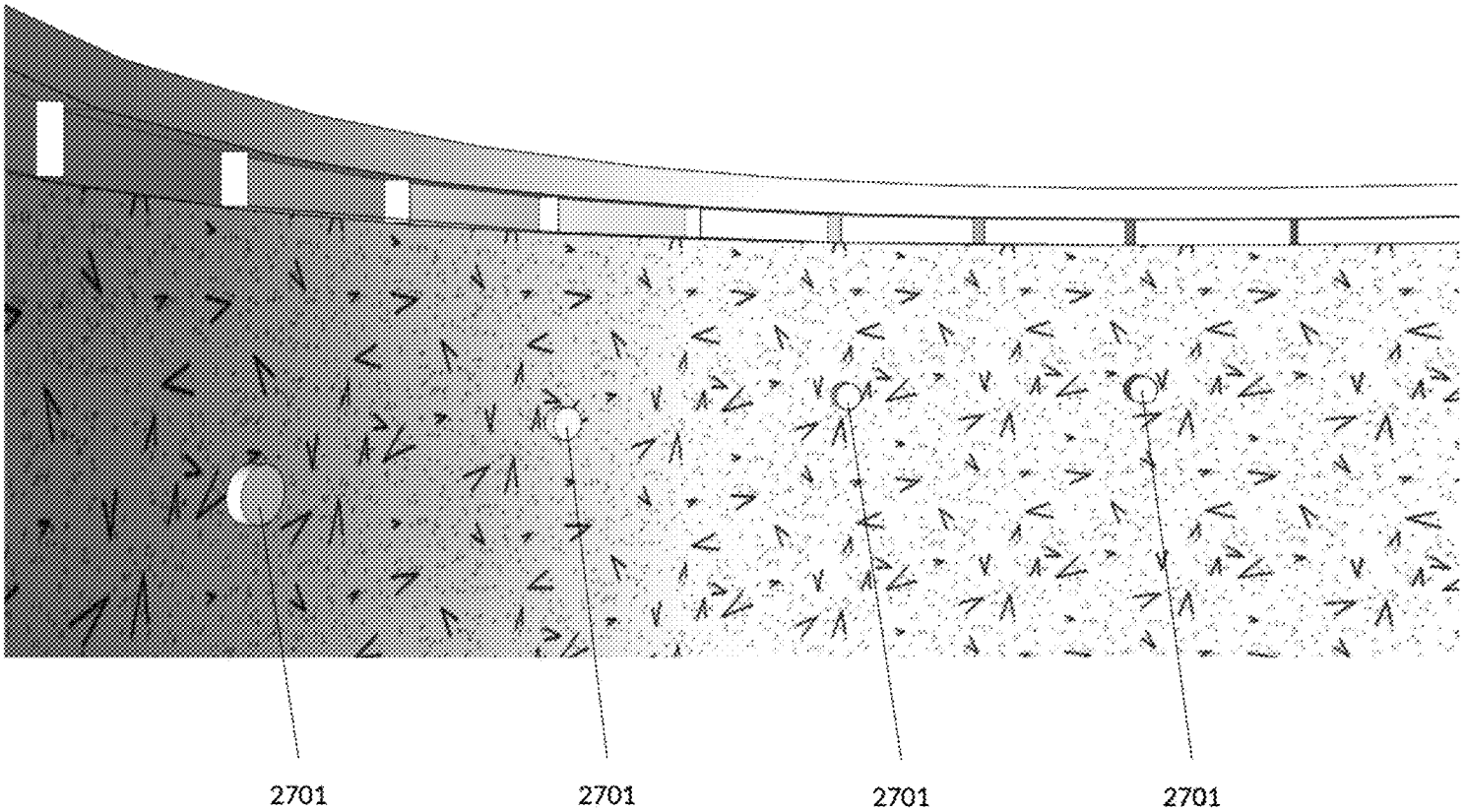
FIG. 27 is an embodiment of the sewer seal displaying multiple button type basket to filter type attachment mechanisms.

Referring now to FIG. 27, which shows an embodiment of the sewer seal displaying multiple button type basket to filter type attachment mechanisms. Basket to filter attachment mechanism 2701 comprises the means by which filter media 107 is attached to filter basket 106. In some embodiments, these mechanisms may be zip ties or other fasteners tied off through grommets. These may be located in the filter media 107 and-or perforations in perforated cylinder 502.

In some embodiments, it is thought that examples of basket to filter attachment mechanism 2701 may include: zip ties, structural configurations, built in hooks, or snaps. One goal of basket to filter attachment mechanism 2701 is to provide a means to attach filter media 107 to filter basket 106.

Figure 28:
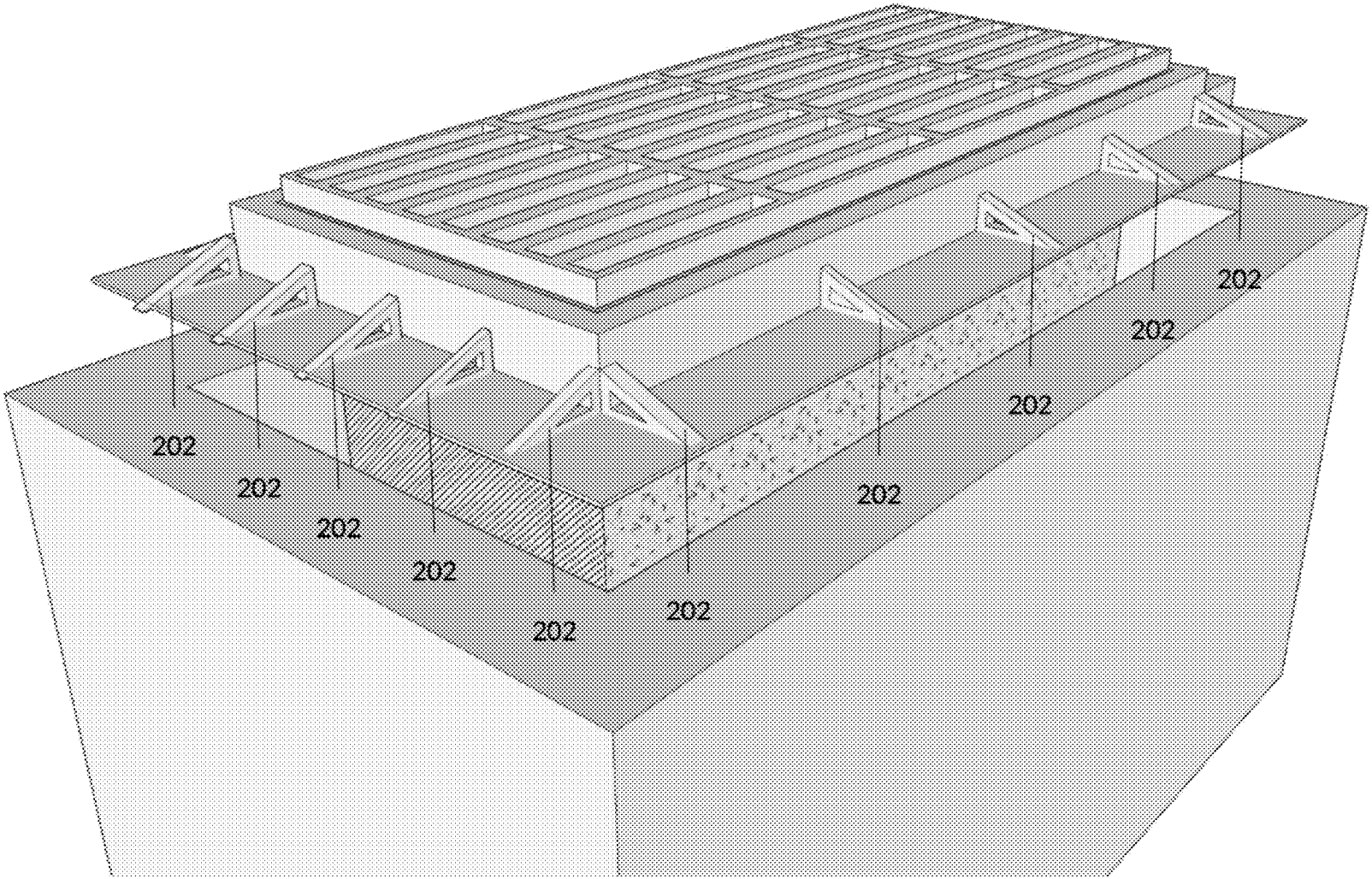
FIG. 28 is an embodiment of a grate where the surrounding substrate affixment system has gussets that provide for integration within poured concrete.

For further illustration of the filtration system, FIG. 28, which shows an embodiment of a grate where the surrounding substrate affixment system has gussets that provide for integration within poured concrete.

Figure 29:
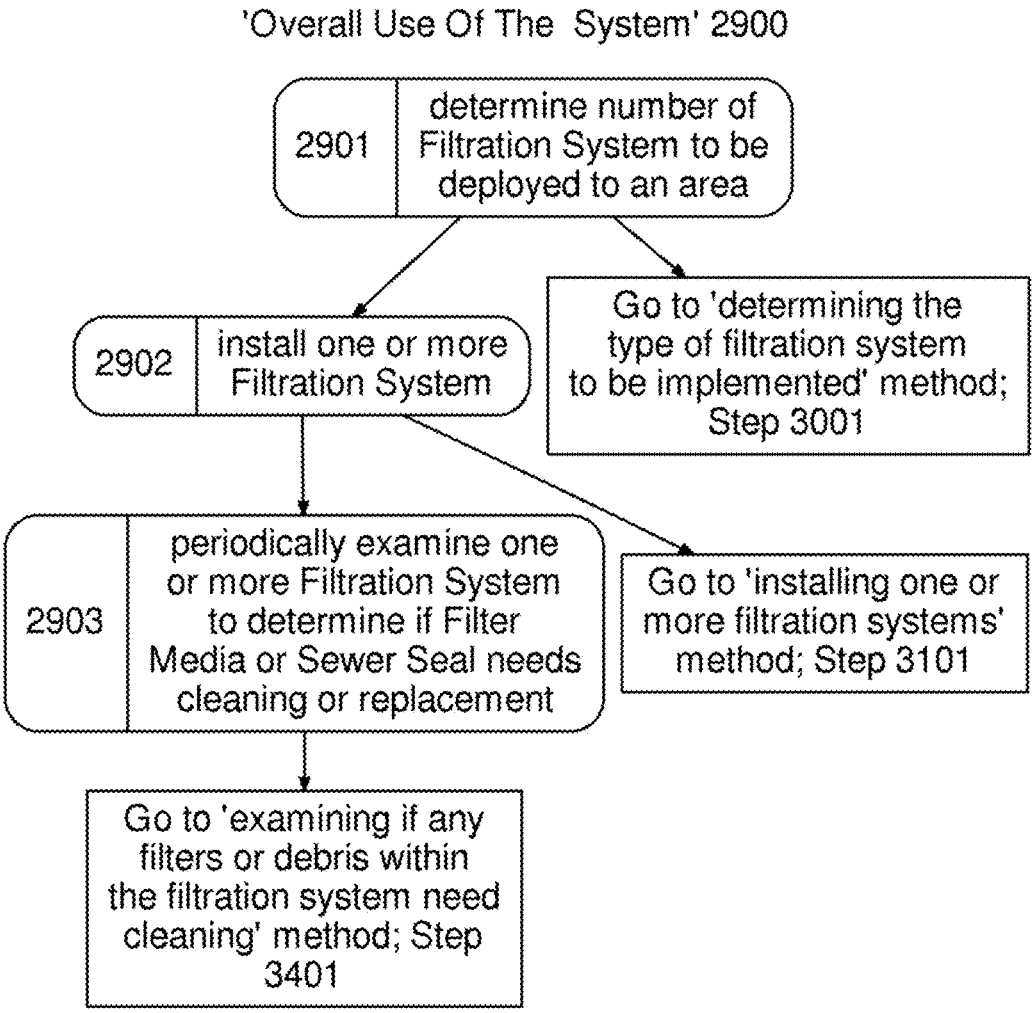
FIG. 29 is a diagram of overall use of the system.

Referring now to FIG. 29, which shows overall use of the system. In a first step, determine number of filtration system 101 to be deployed to an area (Step 2901). Step 2901 is further detailed below in a related method (3000—'determining the type of filtration system to be implemented'). Next, install one or more filtration system 101 (Step 2902). Step 2902 is further detailed below in a related method (3100—'installing one or more filtration systems'). Next, periodically examine one or more filtration system 101 to determine if filter media 107 or sewer seal 108 needs cleaning or replacement (Step 2903). Step 2903 is further detailed below in a related method (3400—'examining if the any filters or debris within the filtration system need cleaning').

Figure 30:
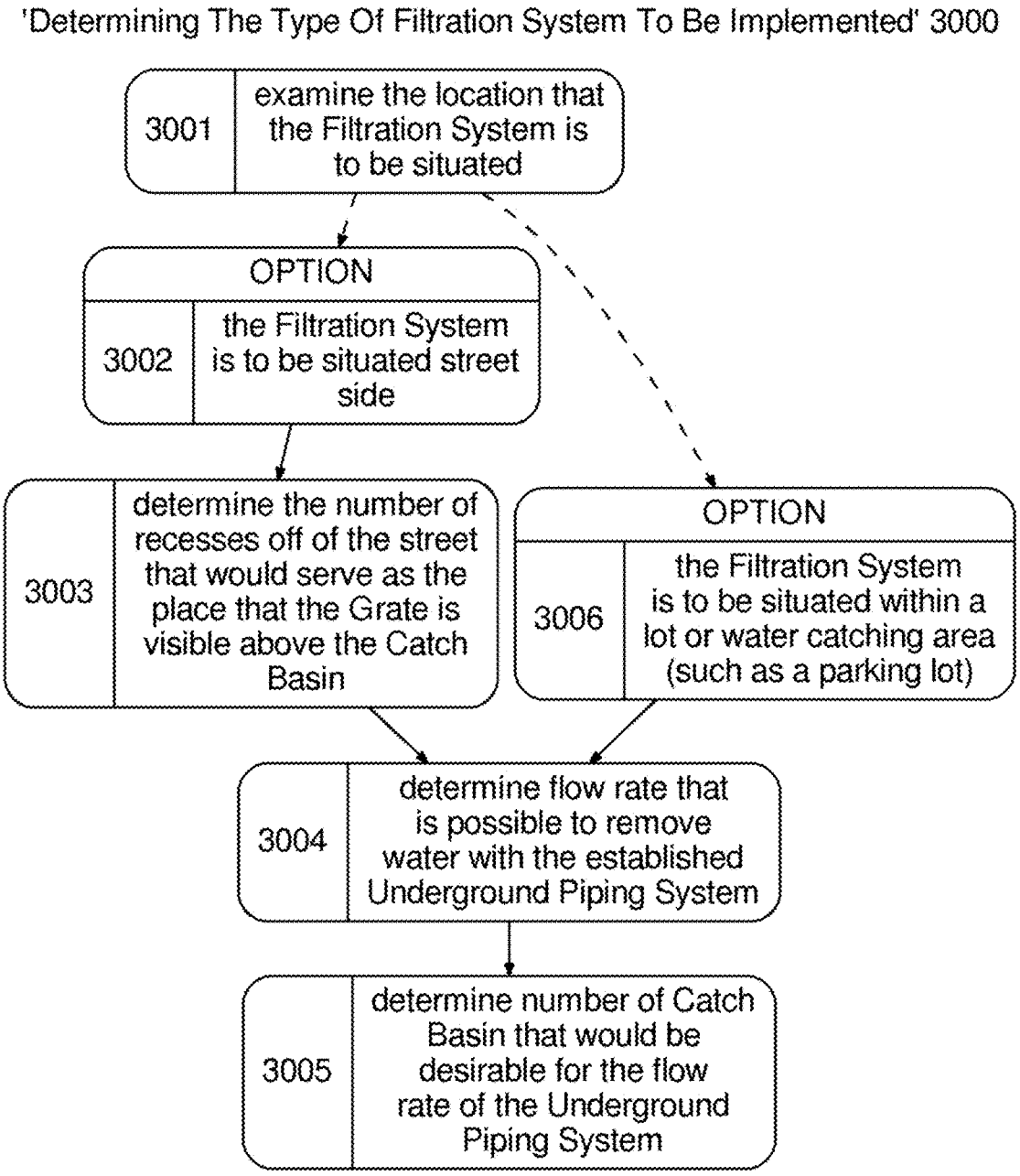
FIG. 30 is a diagram of determining the type of filtration system to be implemented.

Referring now to FIG. 30, which shows determining the type of filtration system to be implemented. In a first step, examine the location that the filtration system 101 is to be situated (Step 3001). If the filtration system 101 is to be situated street side (Step 3002), then determine the number of recesses off of the street that would serve as the place that the grate 103 is visible above the catch basin 105 (Step 3003). Next, determine flow rate that is possible to remove water with the established underground piping system 102 (Step 3004). Next, determine number of catch basin 105 that would be desirable for the flow rate of the underground piping system 102 (Step 3005). From Step 3001, if the filtration system 101 is to be situated within a lot or water catching area (such as a parking lot) (Step 3006), then refer to Step 3004.

Figure 31:
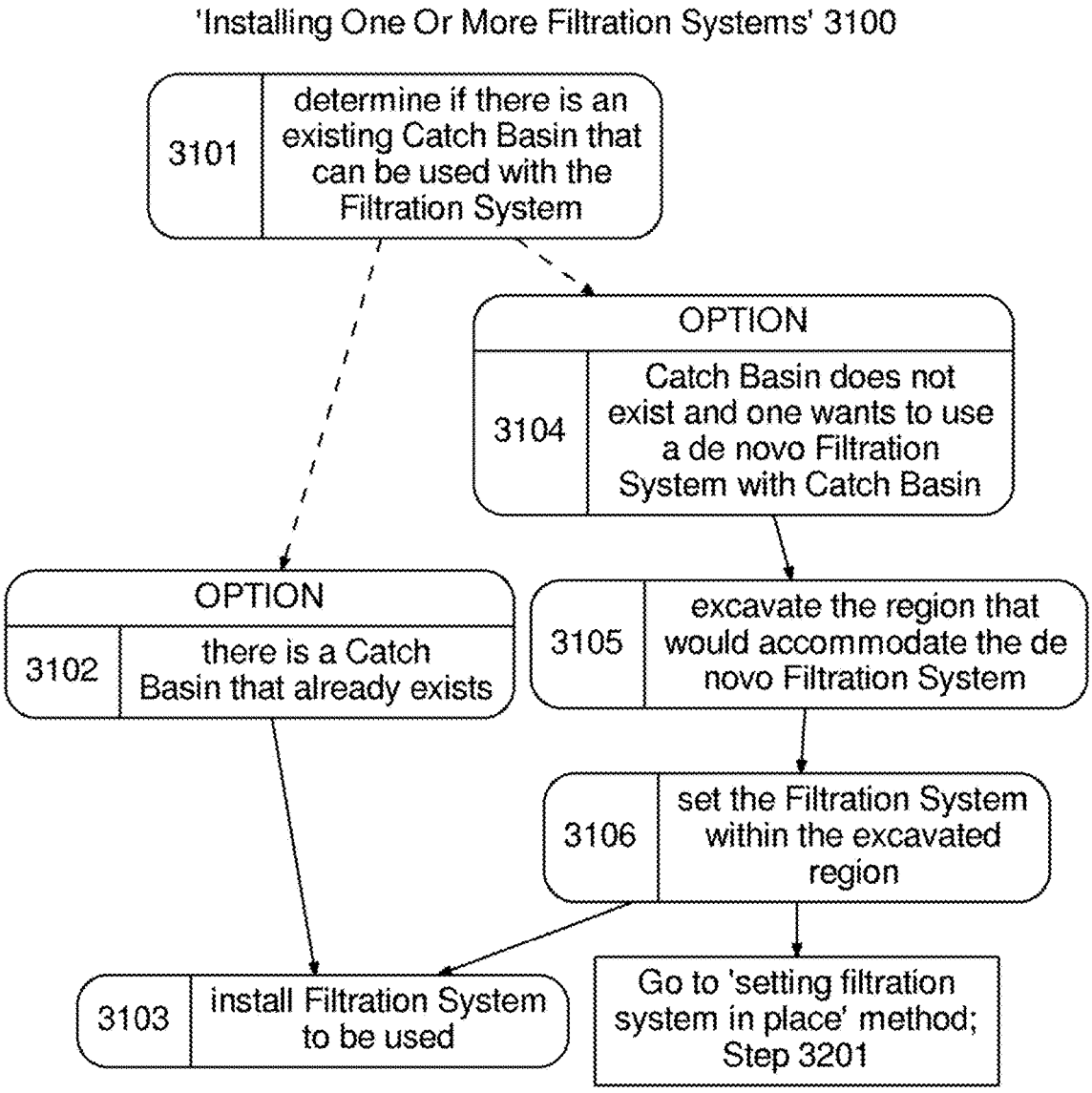
FIG. 31 is a diagram of installing one or more filtration systems.

Referring now to FIG. 31, which shows installing one or more filtration systems. In a first step, determine if there is an existing catch basin 105 that can be used with the filtration system 101 (Step 3101). If there is a catch basin 105 that already exists (Step 3102), then install the filtration system 101 to be used (Step 3103). From Step 3101, if catch basin 105 does not exist and one wants to use a de novo filtration system 101 with catch basin 105 (Step 3104), then excavate the region that would accommodate the de novo filtration system 101 (Step 3105). Next, set the filtration system 101 within the excavated region (Step 3106). Step 3106 is further detailed below in a related method (3200—'setting filtration system in place'). Next, refer back to Step 3103.

Figure 32:
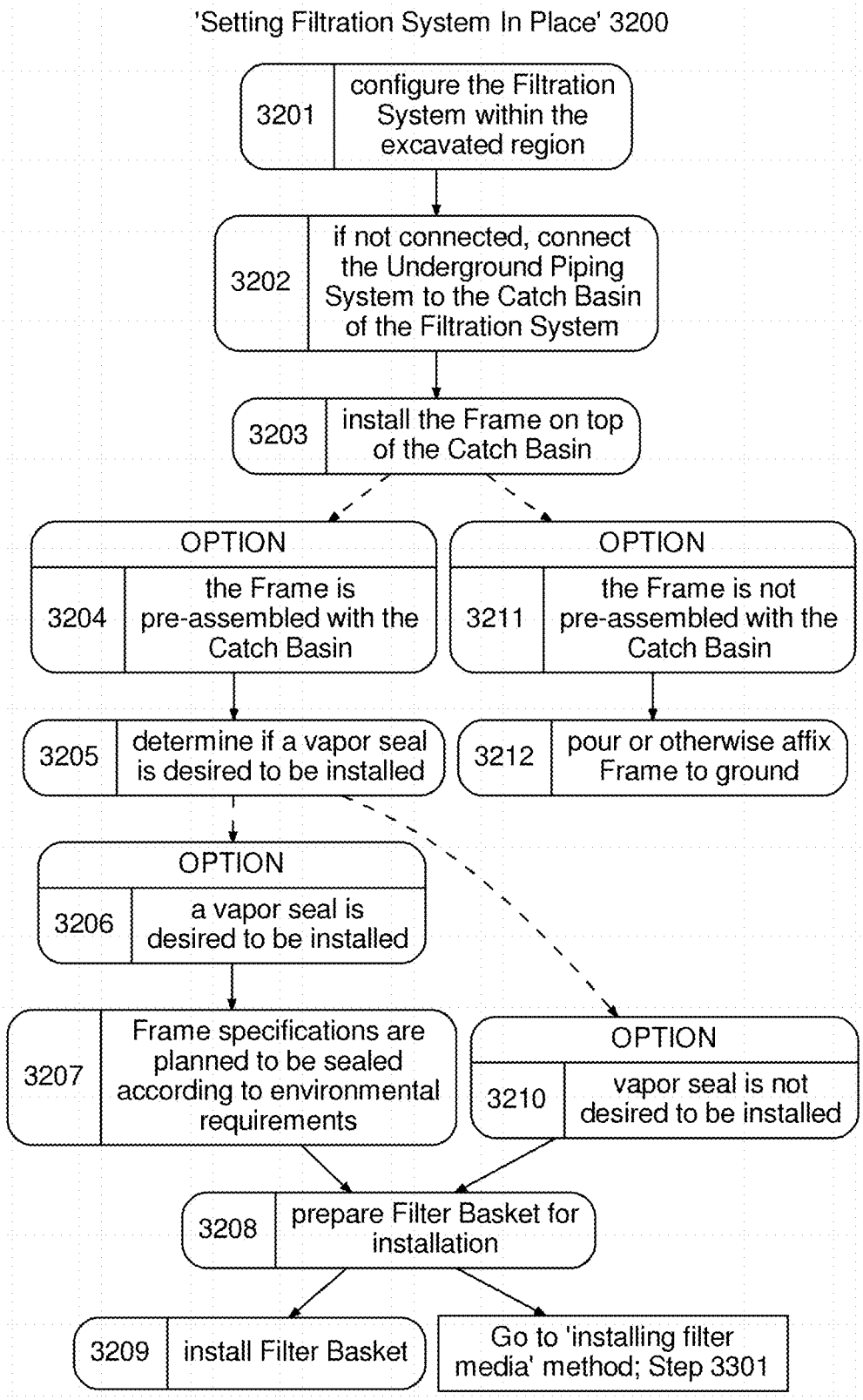
FIG. 32 is a diagram of setting filtration system in place.

Referring now to FIG. 32, which shows setting filtration system in place. In a first step, configure the filtration system 101 within the excavated region (Step 3201). Next, if not connected, connect the underground piping system 102 to the catch basin 105 of the filtration system 101 (Step 3202). Next, install the frame 201 on top of the catch basin 105 (Step 3203). If the frame 201 is pre-assembled with the catch basin 105 (Step 3204), then determine if a vapor seal is desired to be installed (Step 3205).

If a vapor seal is desired to be installed (Step 3206), then frame 201 specifications are planned to be sealed according to environmental requirements (Step 3207). Next, prepare filter basket 106 for installation (Step 3208). Step 3208 is further detailed below in a related method (3300—'installing filter media'). Next, install filter basket 106 (Step 3209).

From Step 3205, if vapor seal is not desired to be installed (Step 3210), then refer to Step 3208. then Step 3208 is further detailed below in installing filter media. From Step 3203, if the frame 201 is not pre-assembled with the catch basin 105 (Step 3211), then pour or otherwise affix frame 201 to ground (Step 3212).

Figure 33:
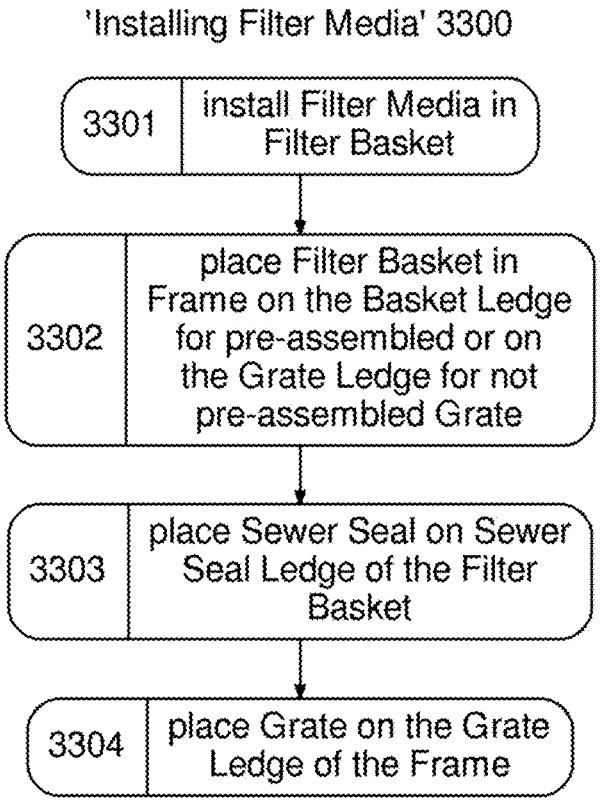
FIG. 33 is a diagram of installing filter media.

Referring now to FIG. 33, which shows installing filter media. In a first step, install filter media 107 in filter basket 106 (Step 3301). Next, place filter basket 106 in frame 201 on the basket ledge 302 for pre-assembled or on the grate ledge 301 for not pre-assembled grate 103 (Step 3302). Next, place sewer seal 108 on sewer seal ledge 503 of the filter basket 106 (Step 3303). Next, place grate 103 on the grate ledge 301 of the frame 201 (Step 3304).

Figure 34:
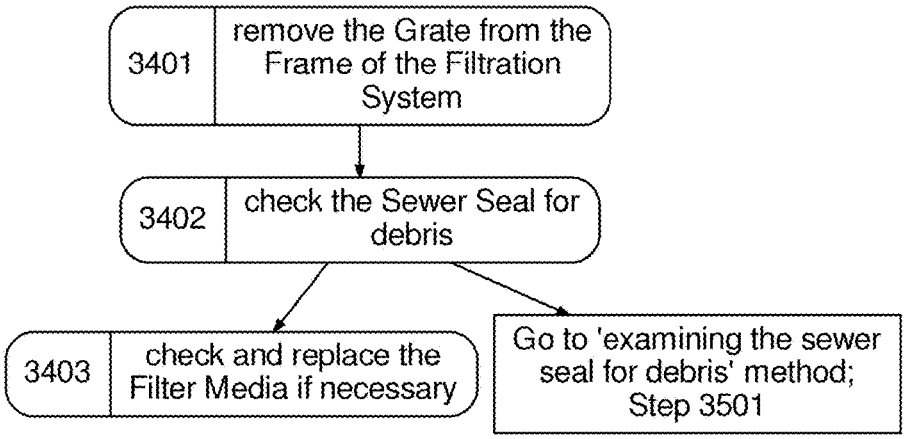
FIG. 34 is a diagram of examining if any filters or debris within the filtration system need cleaning.

Referring now to FIG. 34, which shows examining if any filters or debris within the filtration system need cleaning. In a first step, remove the grate 103 from the frame 201 of the filtration system 101 (Step 3401). Next, check the sewer seal 108 for debris (Step 3402). Step 3402 is further detailed below in a related method (3500—'examining the sewer seal for debris'). Next, check and replace the filter media 107 if necessary (Step 3403).

Figure 35:
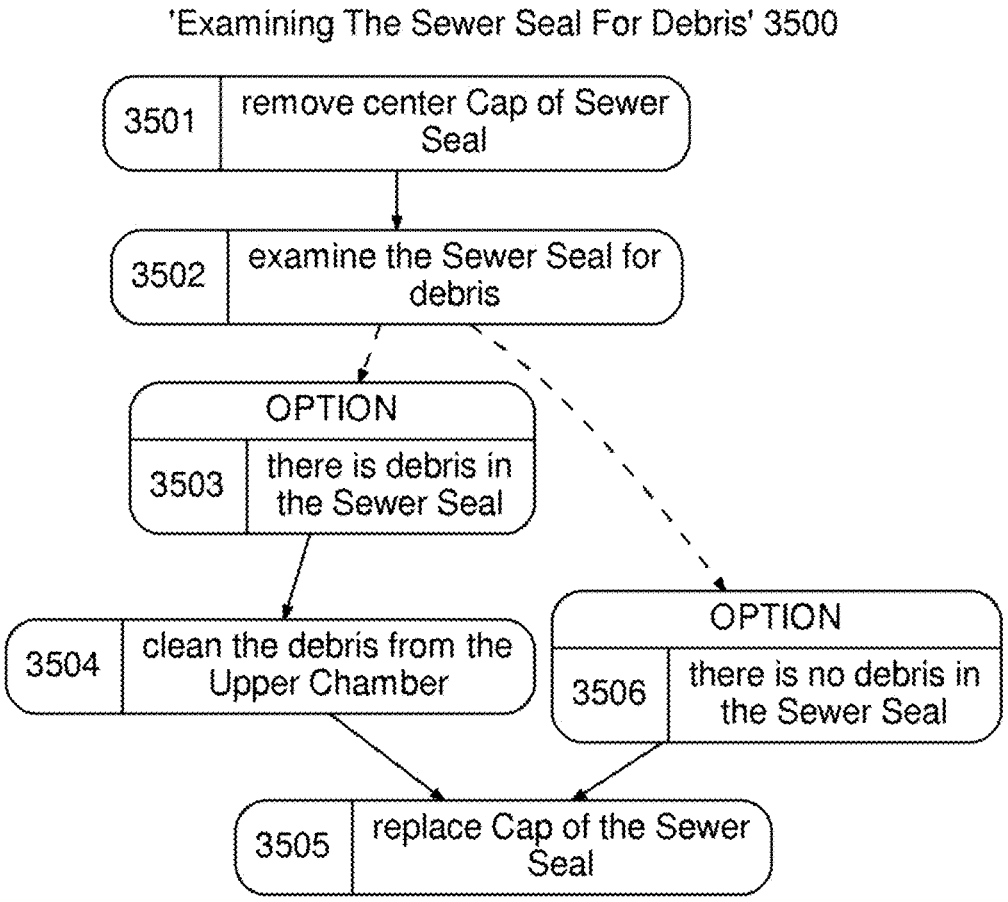
FIG. 35 is a diagram of examining the sewer seal for debris.

Referring now to FIG. 35, which shows examining the sewer seal for debris. In a first step, remove center cap 111 of sewer seal 108 (Step 3501). Next, examine the sewer seal 108 for debris (Step 3502). If there is debris in the sewer seal 108 (Step 3503), then clean the debris from the upper chamber 109 (Step 3504). Next, replace cap 111 of the sewer seal 108 (Step 3505). From Step 3502, if there is no debris in the sewer seal 108 (Step 3506), then refer to Step 3505.

Figure 36:
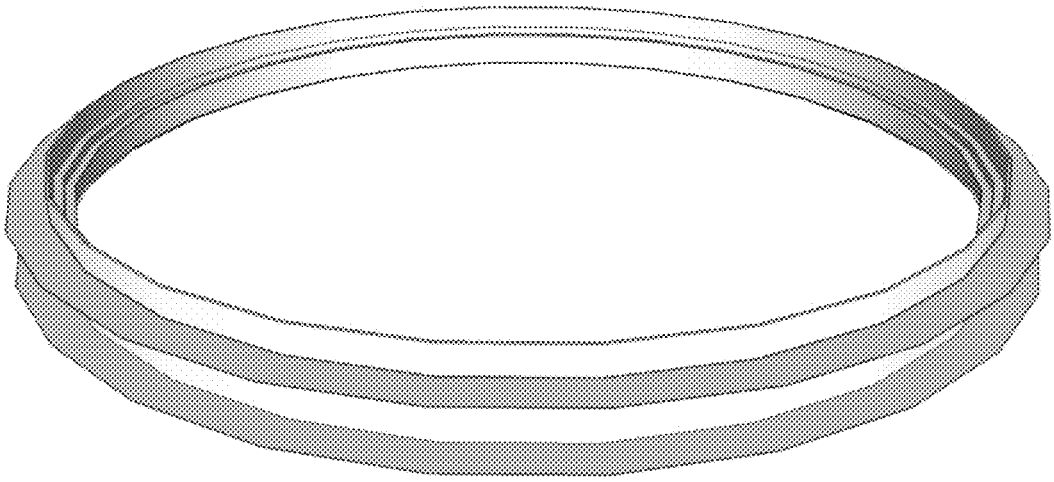
FIG. 36 is an embodiment of the fabricated frame system with an extra ventral flange for fixation by concrete pouring that is positioned on top of a pre cast catch basin for retrofitting existing catch basin units.

For further illustration of the filtration system, FIG. 36 shows an embodiment of the fabricated frame system with an extra ventral flange for fixation by concrete pouring that is positioned on top of a pre cast catch basin for retrofitting existing catch basin units.

The following elements and/or terms ponding, surrounding substrate, perforated cylinder cross braces, feet gap, and cap weir seal distance are important for the working functionality, but do not appear in the drawings and are shown below.

Ponding comprises the process whereby runoff and other liquids accumulate in flat or low areas and cannot drain easily, requiring pumping, evaporation, or slow infiltration into surrounding substrate for removal. Surrounding substrate comprises the layer underlying the filtration system 101, typically concrete, but may also be gravel or dirt.

Perforated cylinder cross braces comprise supporting structures formed by cross bars. Spatially, perforated cylinder cross braces are preferably positioned underneath the bottom of perforated cylinder 502. In some embodiments, it is thought that if perforated cylinder cross braces are absent, then perforated cylinder 502 may be made of more heavy duty material, but this may make filter basket 106 heavier during removal. One goal of perforated cylinder cross braces is to provide additional support when significant debris is in filter basket 106.

Feet gap comprises the space created when cap 111 is in place. In some embodiments, the height of feet gap can be calculated by corresponding to flow rate. In some embodiments, it is thought that if feet gap is absent, then water seal does not form. In other instances, if feet gap is absent, then water does not flow. One goal of feet gap is to allow for water flow.

Cap weir seal distance comprises the distance from the bottom of cap 111 to the top of overflow weir 110. It is the distance needed to form sewer seal 108 to trap gases. In some embodiments, the distance of cap weir seal distance has a preferred distance of 6 inches, but in some embodiments, may range from a minimum of 3 inches to a maximum of 6 inches. In some embodiments, the preferred distance can be calculated by the distance needed to form sewer seal 108 to trap gases. In some embodiments, the minimum distance of cap weir seal distance can be calculated by the distance needed for use in municipal systems.

I claim:

1. A system: wherein said system comprises a removable filtration structure, a catch basin, and a grate wherein said filtration structure is positioned under said grate and said catch basin is positioned under said removable filtration structure;

wherein said removable filtration structure additionally comprises a filter basket, a sewer seal, and a fabricated frame system;

wherein said fabricated frame system is positioned to accept said grate and is positioned above said catch basin and is within a surrounding substrate;

wherein said fabricated frame system additionally comprises a frame operably attached to said catch basin, wherein said frame receives said filter basket and said frame receives said grate;

wherein said filter basket is positioned within said frame, surrounding said sewer seal, and within said catch basin;

wherein said sewer seal is positioned within said filter basket;

wherein said removable filtration structure additionally comprises filter media, wherein said filter media is positioned within said filter basket.

2. The system of claim 1 wherein said frame additionally comprises a grate ledge, a basket ledge, and a surrounding substrate affixment system.

3. The system of claim 2 wherein said grate is configured to sit on said grate ledge and said grate ledge is positioned peripherally to said basket ledge.

4. The system of claim 3 wherein said basket ledge receives said filter basket and is positioned centrally to said grate ledge.

5. The system of claim 4 wherein said surrounding substrate affixment system is a means to affix said frame to said surrounding substrate and level said filtration system to said surrounding substrate.

6. The system of claim 3 wherein said filter basket comprises a perforated cylinder, a filter basket flange, a sewer seal ledge, and a basket to filter attachment mechanism.

7. The system of claim 6 wherein said filter basket flange is positioned on top and peripherally to said perforated cylinder and sits on said basket ledge.

8. The system of claim 7 wherein said perforated cylinder is a means for holding said filter media, and provides surface area of liquids to flow through, while providing support for said filter media.

9. The system of claim 8 wherein said sewer seal ledge is positioned above said filter media and centrally to said filter basket flange and receives said sewer seal.

10. The system of claim 9 wherein said sewer seal comprises an upper chamber a cap and an overflow weir.

11. The system of claim 10 wherein said upper chamber is positioned surrounding and below said cap.

12. The system of claim 11 wherein said cap is positioned within said upper chamber.

* * * * *